US009051759B2

(12) United States Patent
Herdman

(10) Patent No.: US 9,051,759 B2
(45) Date of Patent: Jun. 9, 2015

(54) KEY PLUG FOR A KEY-PROGRAMMABLE CYLINDER LOCK AND KEY-REMOVABLE LOCK CORE

(71) Applicant: SmartLoc Technology, LLC, Cincinnati, OH (US)

(72) Inventor: Rodrick A. Herdman, West Chester, OH (US)

(73) Assignee: Smartloc Technology, LLC, Cincinnati, OH (US)

( * ) Notice: Subject to any disclaimer, the term of this patent is extended or adjusted under 35 U.S.C. 154(b) by 0 days.

(21) Appl. No.: 14/446,406

(22) Filed: Jul. 30, 2014

(65) Prior Publication Data

US 2014/0331726 A1 Nov. 13, 2014

Related U.S. Application Data

(63) Continuation of application No. 13/841,876, filed on Mar. 15, 2013, now Pat. No. 8,794,042.

(60) Provisional application No. 61/674,480, filed on Jul. 23, 2012.

(51) Int. Cl.
*E05B 27/04* (2006.01)
*E05B 27/00* (2006.01)
*E05B 9/08* (2006.01)

(52) U.S. Cl.
CPC ..... *E05B 27/0007* (2013.01); *E05B 27/005* (2013.01); *E05B 9/086* (2013.01)

(58) Field of Classification Search
CPC ..... E05B 35/12; E05B 29/004; E05B 21/00; E05B 9/084; E05B 9/086; E05B 35/08; E05B 27/005; E05B 27/0046; E05B 31/00; E05B 35/125; E05B 35/083; E05B 27/00; E05B 35/10; E05B 63/121; E05B 27/0032; E05B 27/0053
USPC ..... 70/337–343, 382–386, 493–496, 491, 70/DIG. 44, DIG. 71, DIG. 75, 358, 70/367–371, 419, 421, DIG. 37
See application file for complete search history.

(56) References Cited

U.S. PATENT DOCUMENTS

| | | | | | |
|---|---|---|---|---|---|
| 1,135,027 | A | * | 4/1915 | Kohlberger | 70/341 |
| 2,097,192 | A | * | 10/1937 | Jacobi | 70/368 |
| 2,194,469 | A | * | 3/1940 | Fremon | 70/493 |
| 3,206,958 | A | * | 9/1965 | Best | 70/373 |
| 3,486,353 | A | * | 12/1969 | Pilvet | 70/496 |

(Continued)

*Primary Examiner* — Lloyd Gall
(74) *Attorney, Agent, or Firm* — Hasse & Nesbitt LLC; Daniel F. Nesbitt

(57) ABSTRACT

A plug assembly for use in a key-operated lock, having a cylindrical key plug that can rotatable between a key insertion position and a control position, the key plug having a keyway and tumbler bores, an axial groove into the periphery displaced tangentially from the tumbler bores, a curved trough extending radially inwardly from the carriage groove, a control tooling slot formed radially inwardly from the curved trough. A carriage is moveable axially within the carriage groove, and has an outer surface proximate with the cylindrical periphery of the key plug. The carriage has radially-formed retainer bores that align tangentially with the tumbler bores when the carriage is in a position to accept lock configuration change balls. A separate change tooling blade can be inserted into the control tooling slot to raise any change balls within the retainer bores out through an outer opening the retainer bore.

19 Claims, 17 Drawing Sheets

(56) References Cited

U.S. PATENT DOCUMENTS

| | | | | | |
|---|---|---|---|---|---|
| 4,098,103 | A * | 7/1978 | Raskevicius | 70/494 |
| 4,424,693 | A * | 1/1984 | Best et al. | 70/369 |
| 4,446,709 | A * | 5/1984 | Steinbach | 70/496 |
| 4,712,401 | A * | 12/1987 | Monahan | 70/382 |
| 4,836,002 | A * | 6/1989 | Monahan | 70/382 |
| 5,839,307 | A * | 11/1998 | Field et al. | 70/283 |
| 6,382,006 | B1 * | 5/2002 | Field et al. | 70/371 |
| 6,516,643 | B1 * | 2/2003 | Olshausen | 70/337 |
| 7,290,418 | B2 * | 11/2007 | Herdman | 70/383 |
| 7,533,550 | B2 * | 5/2009 | Herdman | 70/340 |
| 7,624,606 | B1 * | 12/2009 | Huang et al. | 70/338 |
| 7,634,931 | B2 * | 12/2009 | Segien et al. | 70/384 |
| 7,685,852 | B2 * | 3/2010 | Komemi | 70/375 |
| 7,802,455 | B2 * | 9/2010 | Herdman | 70/493 |
| 7,905,125 | B2 * | 3/2011 | Herdman | 70/383 |
| 7,958,759 | B2 * | 6/2011 | Herdman | 70/371 |
| 8,109,122 | B2 * | 2/2012 | Herdman | 70/493 |
| 8,151,611 | B2 * | 4/2012 | Herdman | 70/371 |
| 8,291,735 | B1 * | 10/2012 | Damikolas | 70/383 |
| 8,438,890 | B2 * | 5/2013 | Miyake | 70/493 |
| 8,448,484 | B2 * | 5/2013 | Huang et al. | 70/383 |
| 8,794,042 | B2 * | 8/2014 | Herdman | 70/383 |
| 2009/0217720 | A1 * | 9/2009 | Herdman | 70/385 |
| 2009/0277236 | A1 * | 11/2009 | Huang et al. | 70/368 |
| 2010/0199733 | A1 * | 8/2010 | Herdman | 70/493 |
| 2011/0041579 | A1 * | 2/2011 | Chen | 70/495 |

* cited by examiner

KEY PLUG FOR A KEY-PROGRAMMABLE CYLINDER LOCK AND KEY-REMOVABLE LOCK CORE

CROSS REFERENCE TO RELATED APPLICATIONS

This application claims the benefit of U.S. Provisional Application 61/674,480, filed Jul. 23, 2012, and is a continuation of U.S. application Ser. No. 13/841,876, filed Mar. 15, 2013 (now U.S. Pat. No. 8,794,042 that issued on Aug. 5, 2014), the disclosures of which are incorporated by reference in their entireties.

BACKGROUND OF THE INVENTION

This invention relates to a key plug for a key-removable lock core that is manually removable by use of a key, and for a key-programmable lock cylinder.

A key-removable lock core of the type shown, for example, in FIGS. 1-7 of Frank E. Best's U.S. Pat. No. 3,206,958 (the disclosure of which is incorporated herein by reference in its entirety) has been known since the 1920's and have been widely sold and used in a standard configuration and size so as to be readily interchangeable and renewable in the same lock mechanisms. Such standard lock core includes a core body of figure-8 cross section with body a key plug and a full-length thin-walled sleeve within its bottom lobe, the sleeve being rotatable through a limited angle to retract a core-retainer lug thereon. An axial series of pin tumbler barrels extend through the pin tumbler housing formed by the top lobe of the core body, through a thickened portion of the sleeve contained in a broached recess in such upper lobe, and into the key plug. This arrangement forms a full-length operating shear line at the interface between the key plug and the sleeve, and a full-length control shear line at the interface between the thickened portion of the sleeve and the upper lobe of the core body. An operating key will align the tumblers for shear at the operating shear line to allow the key plug to be rotated, while a control key will align the tumblers for shear at the control shear line to allow the sleeve and the key plug together to be rotated to move the retaining lug on the sleeve between a retracted position within the figure-8 profile of the core and a projected position in which such lug is engaged behind a rearward-facing shoulder in the core receptacle to retain the core in such receptacle.

Walter E. Best's et al. U.S. Pat. No. 4,424,693, the disclosure of which is incorporated herein by reference in its entirety, shows another type of key-removable lock core for a lock chamber of figure-8 cross section having a short cylindrical key plug housing fitting the lower lobe of the chamber and a pin tumbler housing containing a series of pin tumbler barrels, two of which are in an extension beyond the key plug housing. A key plug is contained in such housing and a control sleeve aligned with such housing beneath the extension and having pin tumbler bores aligned with said two barrels. Side faces on the pin tumbler housing and spaced from the chamber side wall provide clearance on one side for a retaining lug on the control sleeve retractable into such clearance from core-retaining engagement behind a shoulder in the chamber, and clearance on the other side for a stop lug. An operating key aligns tumblers in all barrels for shear movement at an operating shear line at the outer surface of the key plug. A control key aligns tumblers in the two extension-contained barrels for shear movement at a control shear line at the outer surface of the control sleeve, and tumblers in the other barrels for shear movement at the operating shear line, to permit rotation of the sleeve to retract its retaining lug. The pin tumbler housing may have flat sides which define the lug clearances or may be cylindrical and have clearance recesses cut in it with end faces which ride against the lugs. The core may have a separate face plate, or the pin tumbler housing may itself form the front face of the core.

Peter H. Field's et al. U.S. Pat. No. 6,382,006, the disclosure of which is incorporated herein by reference in its entirety, shows another type of key-removable lock core for a lock chamber of figure-8 cross section having an extended-length control key that engages a control tumbler, unreachable with the operating key. The control key engages the control tumbler across the operating shear line, while freeing movement of the sleeve at the control shear line.

In the above described key-removable lock cores, and other known and described conventional key-removable lock cores, an operating key aligns the tumblers for shear at the operating shear line to allow the key plug to be rotated, while a separate control key aligns the tumblers for shear at the control shear line, to allow the sleeve and the key plug together to be rotated to move the retaining lug on the sleeve between a retracted position within the figure-8 profile of the core and a projected position in which the lug is engaged behind a rearward-facing shoulder in the core receptacle to retain the core in the receptacle.

U.S. Pat. No. 7,958,759, the disclosure of which is incorporated by reference in its entirety, discloses a key-removable lock core that employs an inserted programming key and a control tooling that when inserted into a control slot, biases auxiliary ball pins partially from with control pin bores and partially into an associated operating pin bore to raise operating pins to a shear line, permitting a sleeve to pivot out of engagement with the core receptacle, and the removal of the lock core from the core receptacle. Despite the improvement in removing plug cores with a programming key and a control tool, there remains a need for a key-operable tumbler lock with improved function and security.

U.S. Pat. No. 7,802,455, the disclosure of which is incorporated by reference in its entirety, describes a key-operated programmable cylinder lock for use with a plurality of user keys without disassembling the lock or replacing the tumblers, with reduction or elimination of incidental or accidental re-configuring of the lock. The lock uses lock configuration change balls that move between the driver chamber and a retainer cavity in the plug to reconfigure the lock for operation with different user keys.

SUMMARY OF THE INVENTION

The present invention provides a key plug assembly for a key-operated lock, the key plug assembly comprising: 1) a key plug rotatable between a key insertion position and a control position, having a cylindrical periphery and a longitudinally-arranged keyway, a plurality of radially-arranged tumbler bores that extend from the keyway to the periphery, and an axially arranged groove formed into the periphery of the plug and displaced tangentially from the plurality of tumbler bores, the groove having, in cross-section, a radially-outermost carriage groove, a radially intermediate curved trough extending radially inwardly from the carriage groove, and a tool slot formed radially inwardly from the curved trough; 2) a carriage disposed and moveable axially within the carriage groove between a first and second position, having an outer surface proximate the cylindrical periphery of the key plug, and having a plurality of retainer bores that align tangentially with the plurality of tumbler bores when the carriage is in the second position; and 3) a tooling comprising a blade configured for insertion within the tool slot to intersect at least a portion of the curved trough.

The invention also provides a key-removable lock core comprising: a) a sleeve comprising a lower cylindrical barrel portion having a longitudinally arranged tubular bore, an upper extension having a plurality of spaced-apart radially-arranged operating pin bores, and a securing lug extending from the sleeve; b) a housing having (i) a lower body portion having a longitudinally-arranged tubular bore for receiving the barrel portion of the sleeve, (ii) an upper body portion having a longitudinally-arranged retaining chamber for receiving the upper extension and securing lug of the sleeve, and a plurality of radially-arranged control pin bores extending to the tubular bore to define a control shear line, and (iii) a securing slot to accommodate tangential movement there through of the securing lug; c) a key plug within the tubular bore of the sleeve, rotatable between a key insertion position and a control position, and having a cylindrical periphery, a longitudinally-arranged keyway, a plurality of radially-arranged tumbler bores that extend from the keyway to the periphery, to define an operating shear line, the key plug further having an axially arranged groove formed into the periphery of the plug and displaced radially from the plurality of tumbler bores, the groove having, in cross-section, a radially-outermost carriage groove, a radially intermediate curved trough extending radially inwardly from the carriage trough, and a tool slot formed radially inwardly from the curved trough; d) a plurality of tumbler pins disposed for axial movement within the plurality of tumbler bores; e) a plurality of operating pins disposed for axial movement within the plurality of operating pin bores; f) a plurality of control pins disposed for axial movement within the plurality of control pin bores; g) a carriage disposed and moveable axially within the carriage groove between a first and second position, having an outer surface proximate the cylindrical periphery of the key plug, and having a plurality of retainer bores that register with the operating pin bores of the sleeve when the carriage is in the second position and the key plug is disposed in the control position; h) at least one change ball disposed in at least one of the retainer bores of the carriage and at least partially within the curved trough; and j) a tooling comprising a blade configured for manipulation within the tool slot to intersect at least a portion of the curved trough, for biasing the at least one change ball at least partially out of the curved trough and at least partially into an associated operating pin bore in the sleeve when the key plug is disposed in the control position.

The tooling can comprise a control tooling that is separate from the key plug, wherein the blade of the inserted control tooling raises the at least one change ball only partially out through an outer opening the retainer bore, where the center of the partially-raised change ball remains within the periphery of the key plug.

The tooling can also comprise a change tooling that is separate from the key plug, wherein the blade of the inserted change tooling raises the at least one change ball substantially out through an outer opening the retainer bore, where at least the center of the partially-raised change ball is displaced outside the periphery of the key plug.

The invention also provides a programmable cylinder lock for operating a bolt or a latch, that can be reconfigured to operate with a user key selected from a set of keys, without disassembling the lock or replacing the tumblers, including: a) a set of keys comprising a plurality of user keys; b) a housing having a cylindrical bore with an inner surface and a plurality of driver bores intersecting the inner surface; c) a plurality of drivers, each driver being movable within one of the plurality of driver bores, and having a means for urged each driver toward the inner surface; d) a plug having a cylindrical periphery and rotatably mounted within the bore to form a shear surface at the interface with the inner surface, the plug being rotatable from a key insertion position to an operating position, and to a programming position, the plug having: (i) a keyway configured to receive a key selected from the set of keys, (ii) a plurality of tumbler bores intersecting the plug periphery and the keyway, each tumbler bore being aligned with a corresponding one of the plurality of driver bores when the plug is at the key insertion position to form a pin chamber, and (iii) an axially-oriented groove in the periphery of the plug, displaced tangentially from the plurality of tumbler bores, the groove having, in cross-section, a radially-outermost carriage groove, a radially intermediate curved trough extending radially inwardly from the carriage groove, and a tool slot extending radially inwardly from the curved trough; e) a plurality of tumblers, each tumbler being movable within a corresponding one of the plurality of tumbler bores; f) a carriage disposed and moveable axially within the carriage groove between a first and second position, having an outer surface proximate the cylindrical periphery of the key plug, and having a plurality of radially-formed retainer bores that register with the operating pin bores of the sleeve with the carriage in the second axial position and the key plug is disposed in the control position; g) at least one lock configuration change ball, movable within the lock between at least a second position within the corresponding retainer bore, and a first position within the corresponding driver bore; and h) a change tooling comprising a blade configured for manipulation within the tool slot, to intersect the curved trough, for biasing the at least one change ball at least partially out of the curved trough, and substantially out through an outer opening of the retainer bore, wherein at least the center of the partially-raised change ball is displaced outside the periphery of the key plug when the key plug is disposed in the programming position.

An aspect of the invention includes the plug assembly further comprising at least one change ball that is disposed within a retainer bore and within the curved trough, and can be moved outward radially from the retainer bore and the curved trough when the change tooling is inserted into the tool slot and intersects at least a portion of the curved trough.

Another aspect of the invention includes the carriage further having an axially-arranged change tooling slot along a bottom surface of the carriage, that intersects a lower portion of the plurality of retainer bores, and into which the change tooling is inserted for intersecting at least a portion of the plurality of retainer bores.

A further aspect of the invention includes the carriage having a front end portion that extends through a front face of the key plug when the carriage is in the first position, and a spring means for biasing the carriage toward the first position. The front end portion of the carriage can be manually depressed to move the carriage from the biased first position to the second position so that the carriage bores align with driver bores or operating pin bores of the key-operated lock.

The lock of the invention is functional to change the position of the lock configuration change ball in the lock without disassembling the lock or replacing the tumblers, with reduction or elimination of incidental or accidental re-configuring of the lock.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF EMBODIMENTS OF THE INVENTION

Figure 1:
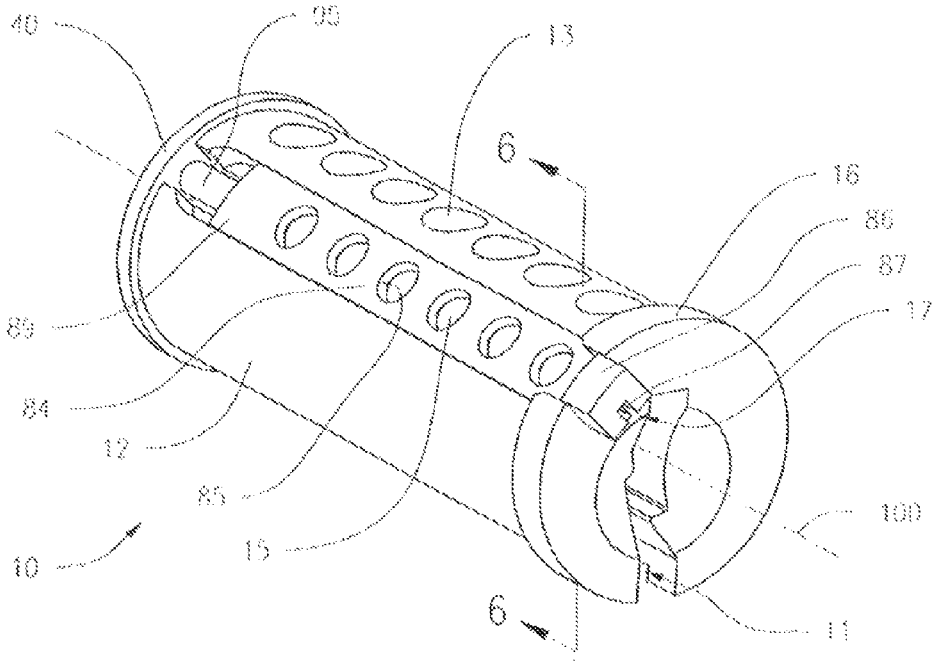
FIG. 1 shows a perspective view of the key plug, carriage, and change balls within the carriage.

As used herein, the phrase "disassembly of the lock" means the removal of the plug from the bore of the housing and removal of the tumbler pins from the tumbler bores of the plug, or the removal of an access panel in the housing and removal of the driver pins and tumbler pins.

As used herein, the term "isolating" means the temporary separation of a pin within one chamber or cavity of the lock from another chamber or pin.

As used herein, the term "integral" means a part or element of a lock that is formed as a unit with the other parts or elements of the lock assembly, which cannot be separated from the other parts or elements of the lock assembly without disassembly of the lock, and in particular disassembly of the plug from the housing.

Key Plug and Carriage Assembly

The present invention provides a key plug assembly that can be employed in a key-operating lock. The key plug assembly includes a cylindrical key plug for rotation within tubular bore of a member of the lock, such as a lock sleeve or housing, between various positions, including a key insertion position and a control position. The key plug has a cylindrical periphery, a longitudinally-arranged keyway, a plurality of radially-arranged tumbler bores that extend from the keyway to the periphery, to define an operating shear line. The key plug also has an axially arranged groove formed into the periphery of the plug. The groove retains a carriage having a plurality of retainer bores within which lock configuration change balls can be disposed during operation of the lock.

FIGS. 1-11 show the key plug 10 having a cylindrical periphery 12, a radial flange 16 at its front end, a keyway 11 extending axially through its length, and a plurality of tumbler bores 13 that extend between the keyway 11 and the periphery, and that are spaced apart along the centerline 100. The tumbler bores 13 align with the operating pin bores 23 and the control pin bore 33 to form pin chambers in the lock, as later described herein.

In the illustrated embodiment, the key plug 10 has a plurality of cavities disposed in the periphery 12 to accommodate lock configuration change members, illustrated as change balls 15. The lock configuration change members may be other shapes, such as a barrel shape. Any number of cavities and change members can be provided. The cavity is defined within a retainer bore 85 formed into a carriage 84, which is disposed within a groove 80 formed into the periphery of the plug.

As shown in FIG. 1, the carriage 84 is disposed within the groove 80 and has a forward tapered end 86 that extends through an opening 17 formed in the front flange 16. The groove 80 extends axially in the periphery, displaced tangentially from the plurality of tumbler bores, and has a carriage groove 81, a curved trough 82 and a tool slot 83. The groove 80 is typically displaced about 30 to about 90 degrees, right or left, from the tumbler bores. The carriage groove 81 is substantially rectangular in cross section along the axial length of the plug periphery, and is tapered at the rear end of the plug. The carriage 84 rests within the carriage groove 81, with minimal clearance along its sides, and movable between a first, forward position, where the front end 86 extends from the front flange 16 of the plug 10 (shown in FIG. 1), and a second, rearward position, where the rear end 89 stops against the taper of the carriage groove 81. A spring or other biasing means 89 biases the carriage toward the forward position.

Figure 4:
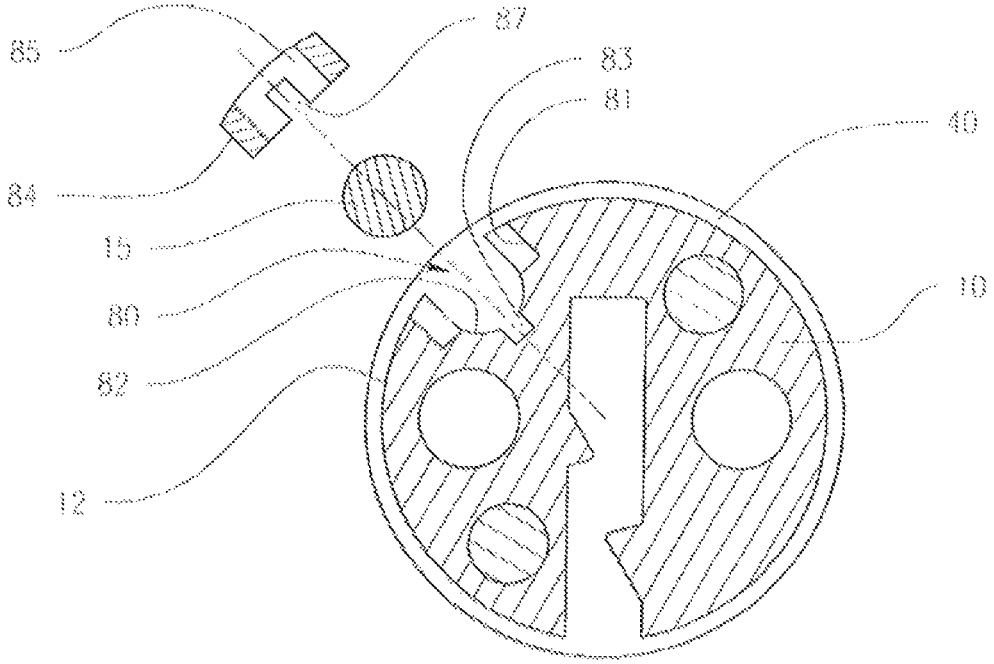
FIG. 4 shows a front section view of the key plug, carriage, and the change balls from line 4-4 of FIG. 2.
Figure 6:
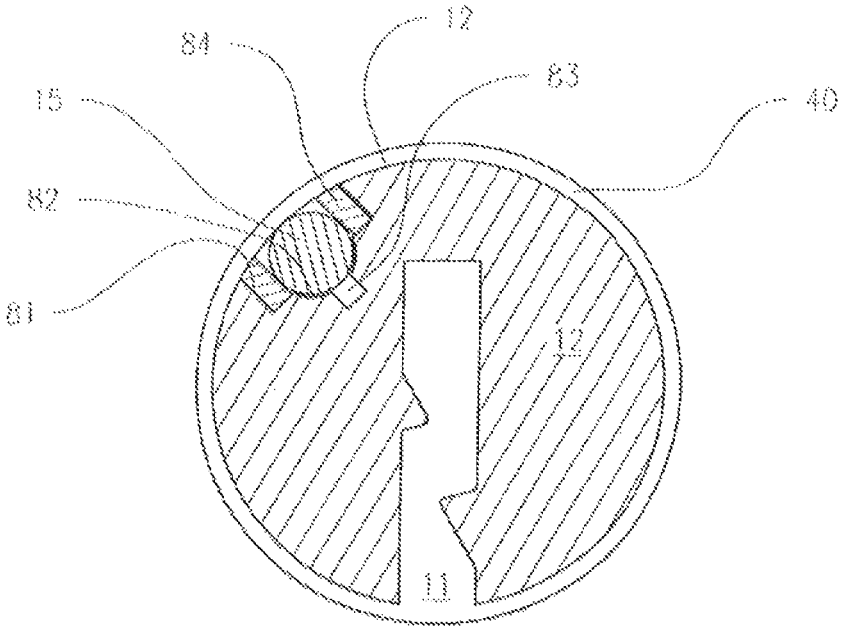
FIG. 6 shows cross sectional view of the key plug, carriage and change ball, viewed through line 6-6 of FIG. 1.

The axially-arranged curved trough 82 extends radially and inwardly at the center of the carriage groove 81, in a semi-circular shape, and extends axially from (not through) the front flange 16 to and through the rear of the key plug 10. The cross sectional shape of the curved trough 82 accommodates the rolling movement of the change balls 15 when disposed within the carriage bores 85, as shown in FIGS. 4 and 6.

Figure 2:
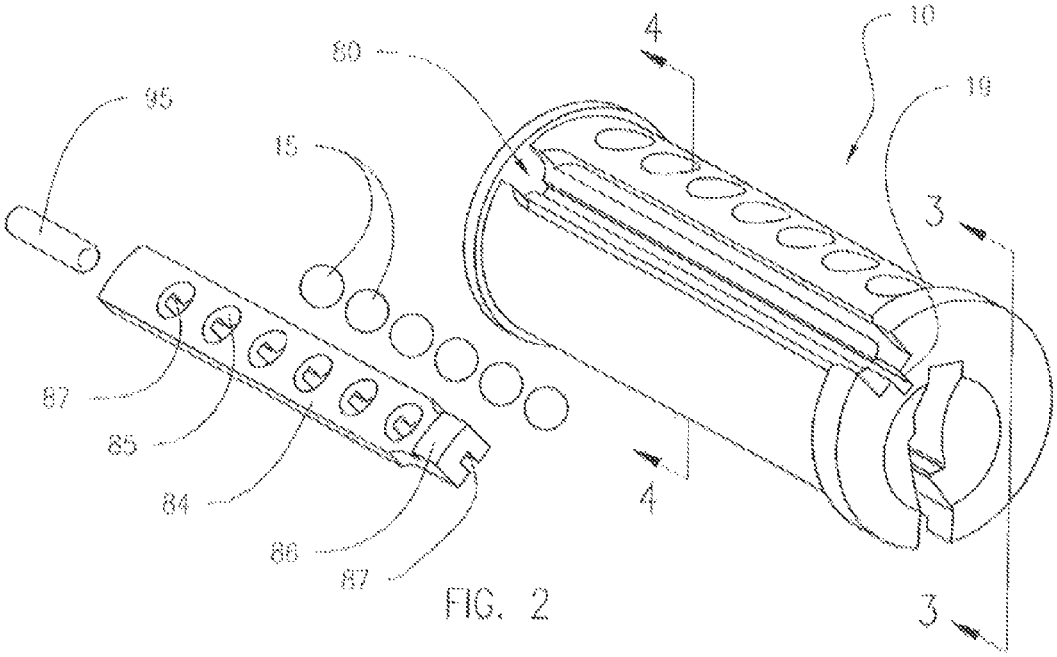
FIG. 2 shows an exploded view of the key plug with the carriage and the change balls.
Figure 3:
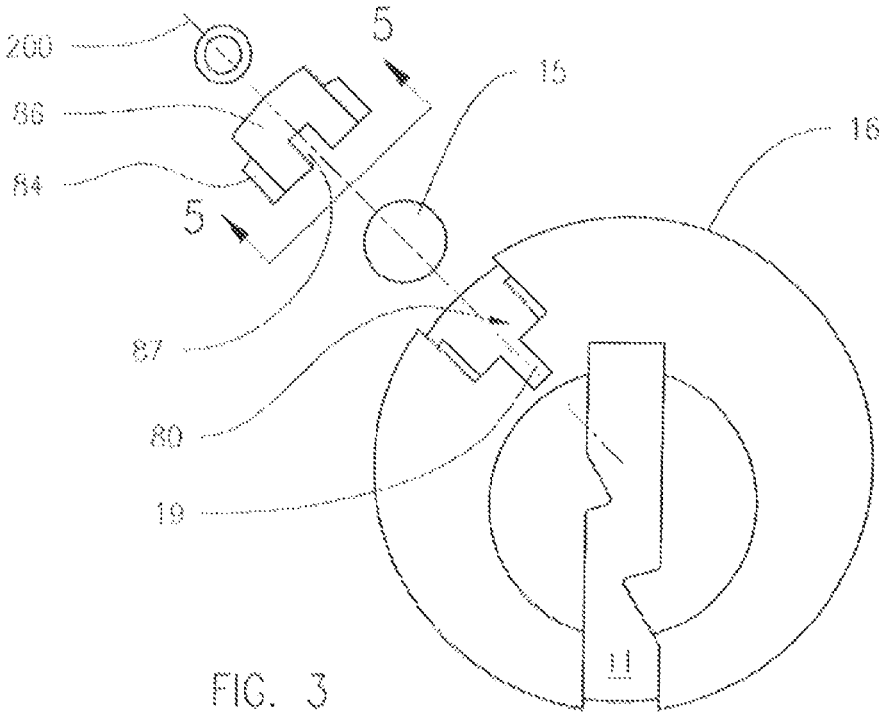
FIG. 3 shows a front elevation view of the key plug, carriage, and the change balls from line 3-3 of FIG. 2.

An axially-arranged tool slot 83 extends radially and inwardly at the center of the curved trough 82, and extends axially through the front flange 16 (FIG. 3) and the through the rear face of the key plug (FIG. 2).

The groove 80 can be formed into the key plug 10 by any one or combination of well known machining techniques.

Figure 7:
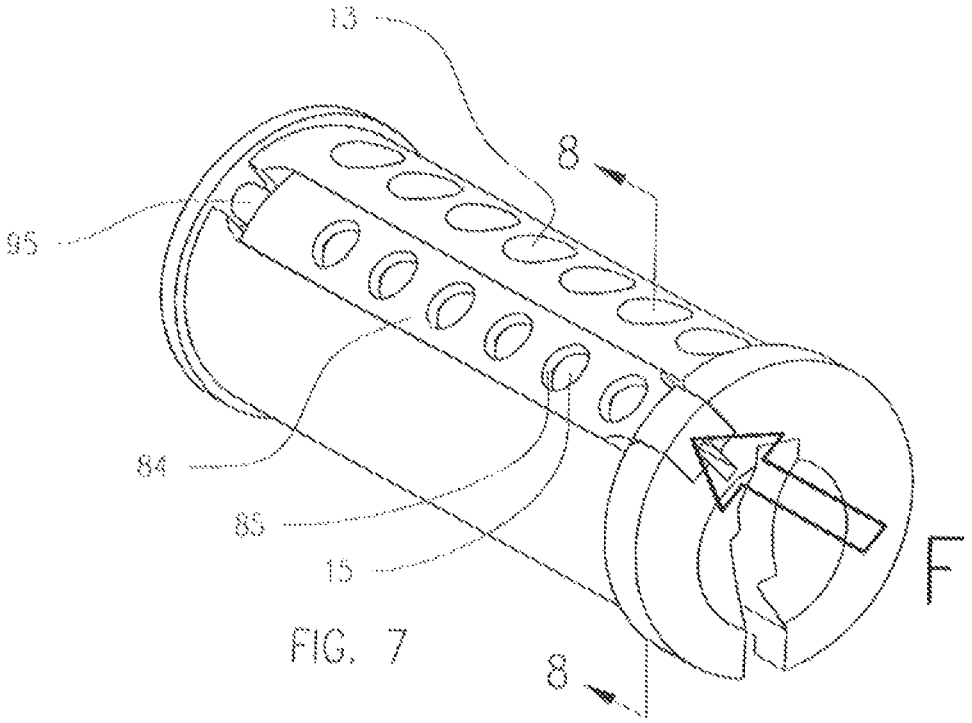
FIG. 7 shows a perspective view of the key plug and change ball, with the carriage in an aligned position.
Figure 8:
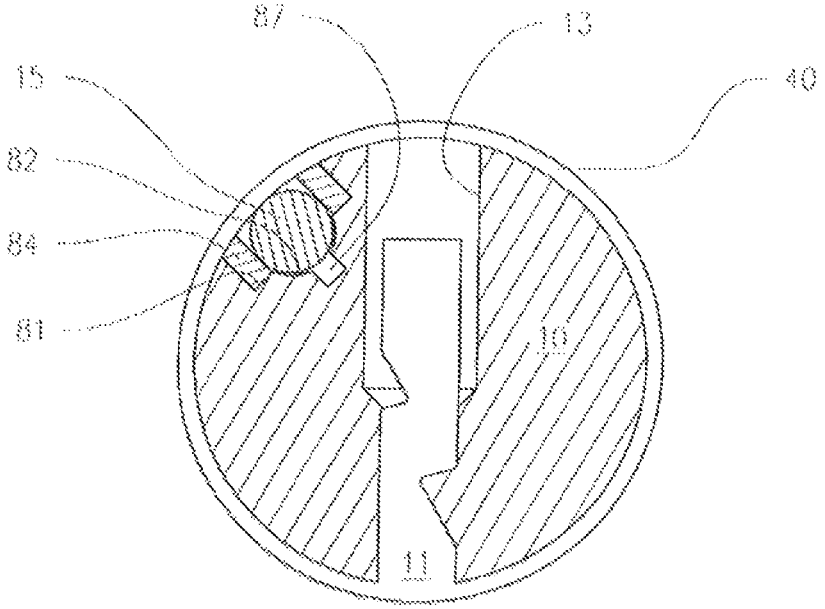
FIG. 8 shows cross sectional view of the key plug, carriage and change ball, viewed through line 8-8 of FIG. 7.
Figure 9:
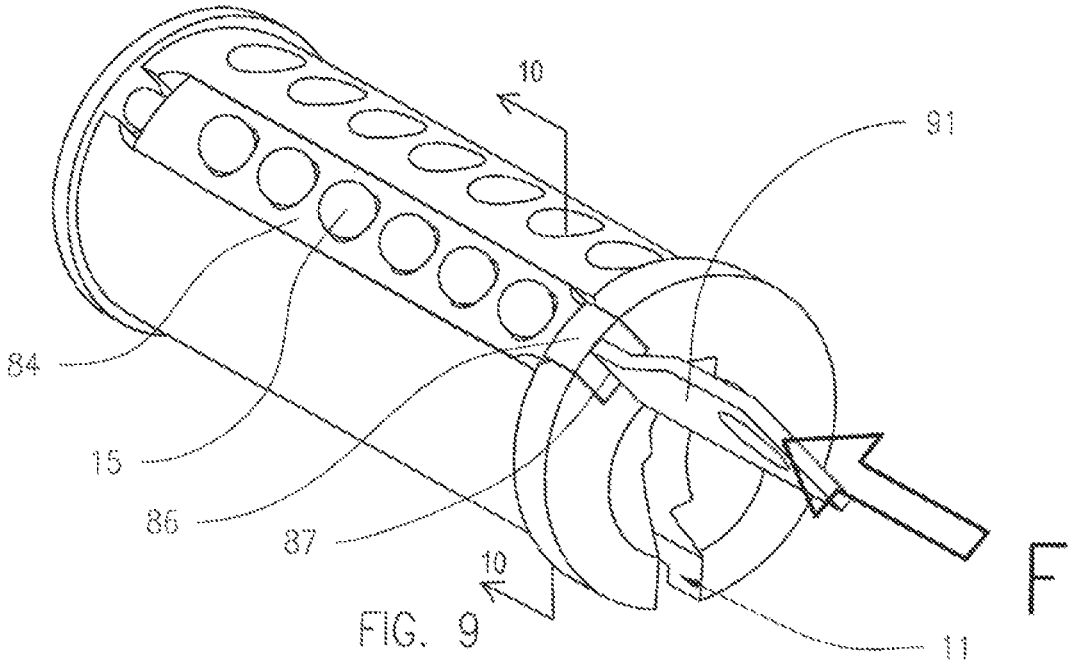
FIG. 9 shows the key plug of FIG. 8, with a change tooling being inserted into the carriage slot for raising the change ball from the carriage bore.

The carriage 84 has a substantially rectangular cross sectional shape with a curved upper surface that lies proximate, and typically flush, with the key plug periphery 12 (FIG. 6), and with a substantially flat bottom and perpendicular sides that fit for axial sliding into the carriage groove 81. The carriage 84 has a plurality of radially-oriented, circular retainer bores, which are sized to accommodate the change balls 15 and are spaced axially along the carriage to register tangentially with a respective tumbler bore 13 when the carriage is disposed in its second position (FIGS. 7 and 8).

As seen in FIG. 6, the change ball 15 when disposed within the cavity of the key plug assembly has its upper portion disposed within the retainer bore 85 of the carriage 84, and just within the periphery 12 of the plug, and its lower portion disposed below the carriage 84 and within the curved trough 82, above the tool slot 83.

Figure 5:
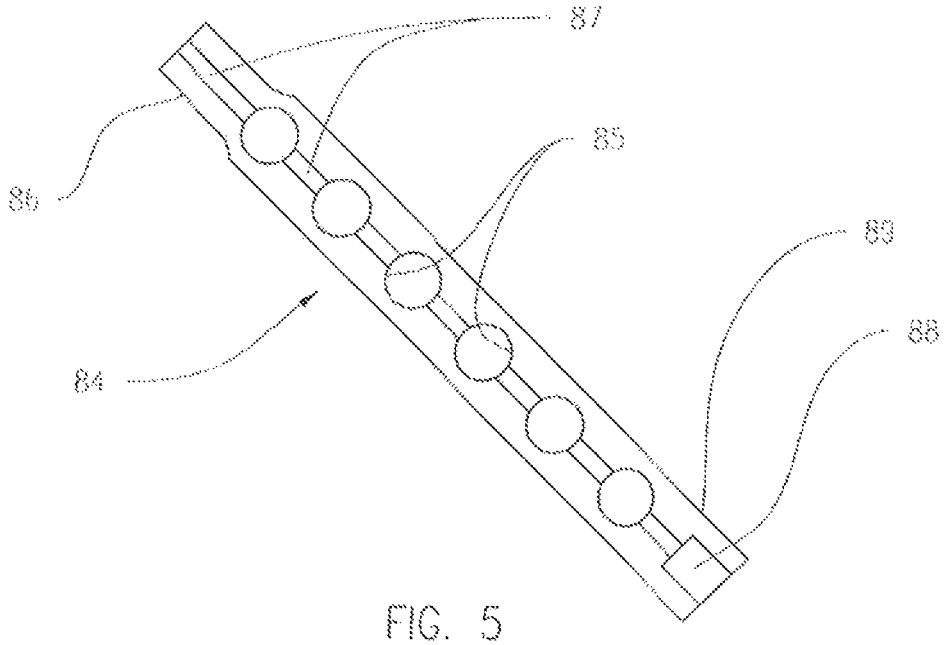
FIG. 5 shows a bottom view of the carriage, viewed from line 5-5 of FIG. 3.

The carriage 84 also has an axially-arranged change tooling slot 87 along the bottom surface, typically centered, that intersects the lower portions of the plurality of retainer bores 85 (FIGS. 2, 4 and 5). The slot 87 is typically rectangular in cross section, to accommodate the typically rectangular tooling blade, though other shapes can be used.

The rear end 89 of the carriage 84 includes a cavity 88 (FIG. 5) on the underside to accommodate one end of a biasing spring 95 (FIG. 1), to bias the carriage forwardly within the carriage groove 81. A force (F), typically a manipulation with a finger or thumb of a person using the lock, can be applied to the front end 86 (the button) of the carriage 84 that extends through the front flange 16, to move temporarily the carriage 84 to its second position, as shown in FIGS. 7 and 8. A plate 40 is screwed to the rear face of the key plug 12 to secure the biasing spring 95.

In an embodiment of the invention wherein the key plug 10 has been rotated to a position where the retainer bores 85 are aligned with driver bores of the lock housing, described herein later (and illustrated in FIG. 21, for example), a tooling blade can be inserted through the tooling slot 19 in the front flange 16 (FIG. 3), and through the tool slot 83 of the groove 80. Depending upon the height of the tooling blade, a change ball 15 can be lifted within the retainer bore 85.

Figure 10:
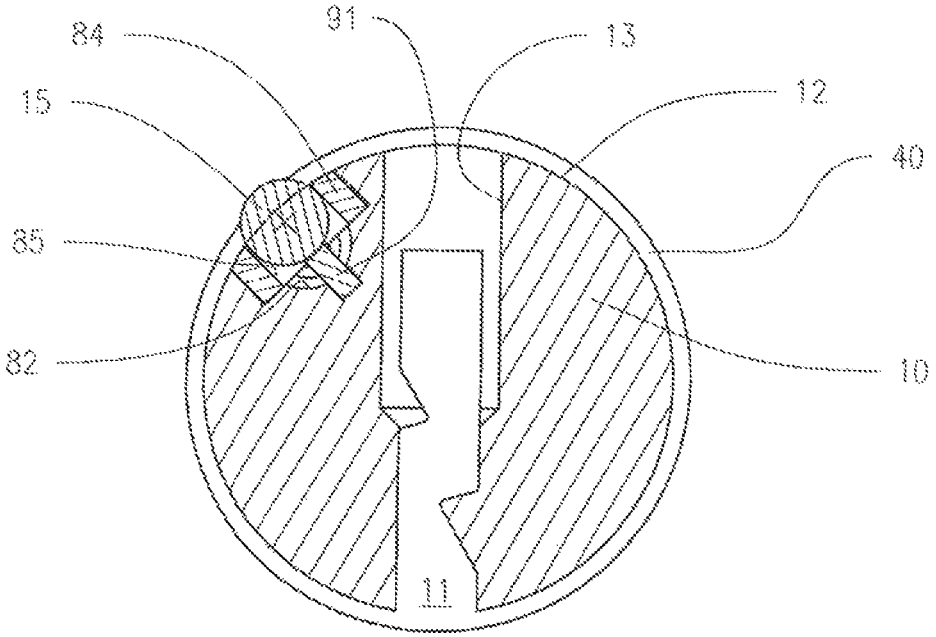
FIG. 10 shows a cross sectional view of the key plug, carriage and change ball, viewed through line 10-10 of FIG. 9, employing a control tooling blade that only partially raises the change ball out of the retainer bore.

In one embodiment of the invention, as shown in FIG. 10, the tooling is a control tooling 91, having a blade height that extends into the curved trough 82, but only by a height that can raise the change ball only partially out through the outer opening the retainer bores 85. With the retainer bores 85 aligned with operating pin bores 23 of the sleeve 20, less than a majority of the partially-raised change ball 15 extends outward from the periphery 12, and only by a "change height" distance. The center of the partially-raised change ball 15 remains within the periphery 12, and the change ball cannot be biased out of the retainer bore 85 and into the operating pin bore 23 when the plug 10 is rotated away. The control tooling 91 is used to control pin alignment to provide shear line separation along the control shear line as described herein later.

Figure 11:
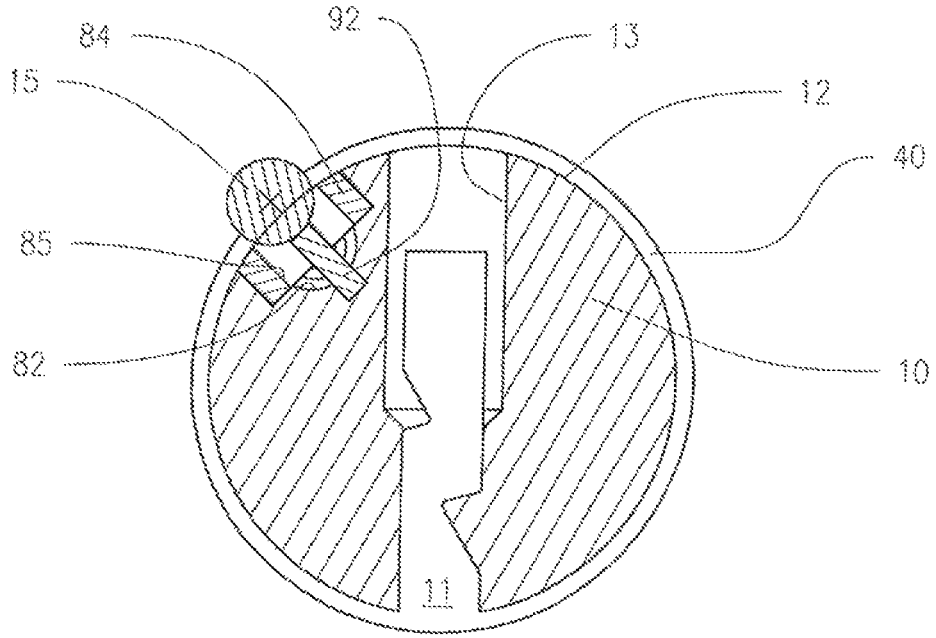
FIG. 11 shows a cross sectional view of the key plug of FIG. 10, instead employing a change tooling blade that substantially raises the change ball out of the retainer bore.

In another embodiment of the invention, as shown in FIG. 11, the tooling is a change tooling 92, having a blade height that extends into the curved trough 82, and typically into the change tooling slot 87 within the carriage 84, and raises the change ball substantially out through the outer opening the retainer bores 85. With the retainer bores 85 aligned with operating pin bores 23 of the lock housing, the majority of the raised change ball 15 extends outward beyond the periphery 12, wherein at least the center of the raised change ball 15 is displaced outside the plug periphery 12, and optionally the entire ball 15 is displaced outside the periphery, and the change ball 15 is moved into the operating pin bore 23 when the plug 10 is rotated away, by the shearing of the operating pin bore along the periphery.

It can be appreciated that for locks which can accommodate access to the plug from the rear of the lock, that the tooling slot(s) can extend through the rear face of the key plug 10.

Figure 31:
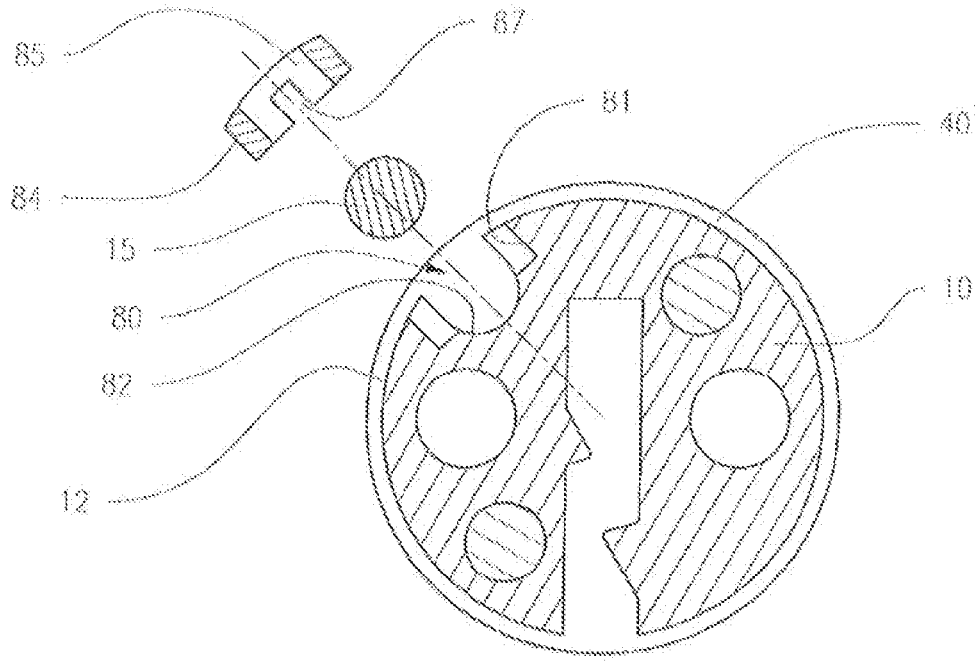
FIG. 31 shows a front section view of an alternative embodiment of a key plug, carriage, and the change balls, viewed similarly to FIG. 4.

In an alternative embodiment of a key plug assembly shown in FIG. 31, the groove 80 includes the carriage groove 81 and the curved trough 82, but does not have a tool slot 83 at the center of the curved trough 82. The carriage 84 is substantially as described herein above in the previous embodiment. This embodiment reduces the amount of machined metal removed from the plug body, though typically requires a change tooling with a shorter (height) blade and a more-pointed leading edge for lifting each change ball 15 within the retainer bores 85. The bottom portion of the curved trough 82 is configured to align substantially with the bottom edge of the tooling slot 19 in the front flange 16 of the plug 10, so that an inserted control tooling or change tooling passes through the tooling slot 19 and along the bottom portion of the curved trough, to leverage under the change members 15.

Figure 32:
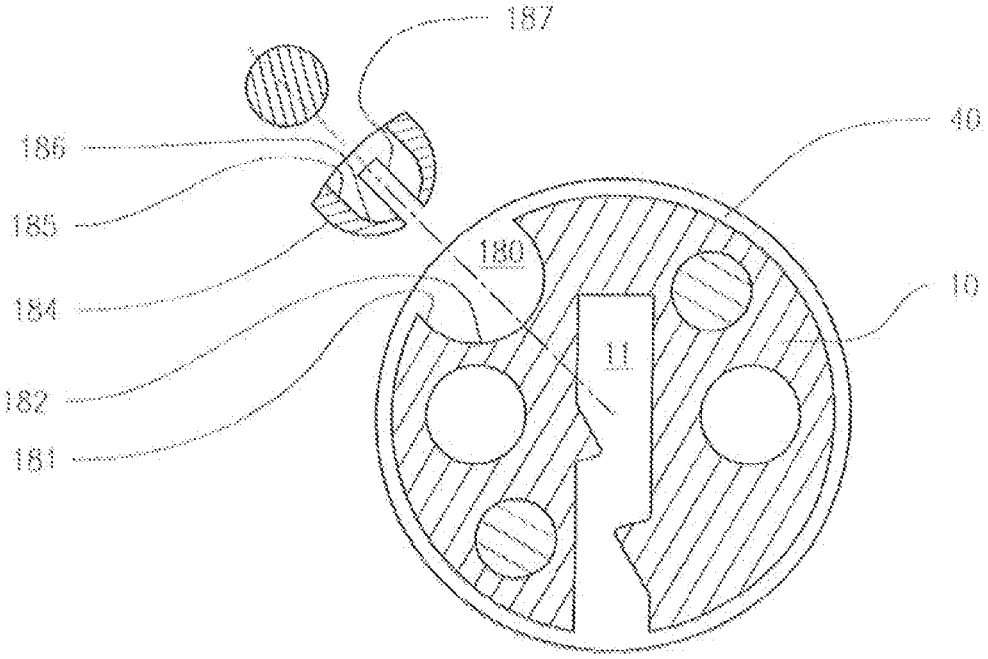
FIG. 32 shows a front section view of another alternative embodiment of a key plug, carriage, and the change balls, viewed similarly to FIG. 4.

In another alternative embodiment of a key plug assembly shown in FIG. 32, the groove 180 includes the upper groove portion 181 and a lower curved trough portion 182, but does not have a distinct tool slot at the center of the curved trough portion 182. The groove 180 is configured to be formed with a single pass of a machining tool, to minimize machining steps. The carriage 184 is configured in cross section to match substantially the cross-sectional shape of the formed groove 180, and includes outer walls (in the illustrated cross-section) shaped to match the upper groove portion 181 and lower curved portions 182 of the plug groove 180. The carriage 184 has a plurality of cup-like receptacles 185 having bottom portions 186 that are configured to retain or hold the change ball 15 therewithin. Consequently, the change balls 15 do not roll along the bottom of the curved trough, as in the previous embodiment, but are carried within the receptacles 185. The change tooling slot 187 is formed along the length of the carriage 184, through the bottom and lower portion of the carriage, typically centered, and intersects at least the lower portion of the plurality of receptacles 185.

The key plug assembly described herein above can find use in a wide variety of key-operated locks employing one or more retainer cavities and one or more change members associated therewith whose positioning within the retainer cavity can affect the lock configuration to operate with one of a set of user keys or with lock operation and function, including those locks described in U.S. Pat. Nos. 7,533,550, 7,290,418, 7,905,125, 7,958,759, and 7,802,455, the disclosures of which are incorporated herein by reference in their entirety.

Key-Removable Lock Core

A first embodiment of a key-removable lock core assembly of the present invention is shown in FIGS. 12 through 23. This embodiment shows a key-removable lock core having a full-length cylindrical key plug assembly as described herein before, including key plug 10 disposed within the sleeve and housing, and a separate tooling for manipulating the control pin or pins.

Like reference numerals designate like elements throughout the several views.

A retainer bore 85 and its associated auxiliary control pin 15*a* are associated with pin chamber "a", which is the first chamber inboard from the front end of the key-removable lock core 8. Likewise, pin chamber "b" would be the second pin chamber inboard from the front end, etc.

The key-removable lock core comprises a sleeve 20 comprising a lower cylindrical barrel portion 22 having a longitudinally arranged tubular bore 21 centered on centerline 100 for receiving the key plug 10, and comprising on its upper side an extension 24 having a plurality of operating pin bores 23 extending radially from and spaced apart along the centerline 100. The sleeve 20 has a securing lug 27 extending radially from a rear portion of the sleeve 20, and integrally and tangentially from the sleeve extension 24, to define a securing lug profile in cross section. The securing lug 27 has a forward-facing lug face 26 that defines a recess 29 forward of the securing lug 27. The key plug assembly is secured rotatably within the sleeve 20 with end plate 40 using screws. A latch plate 97 includes posts 98 that extend through the end plate 40 and into the key plug 10, for rotating the key plug 10 within the sleeve 20. The rear of the latch plate 97 extends through an opening in the back of the core receipt cal 4, and is held rotatably to the back of the core receptacle 4 with a lock spring 99.

The key-removable lock core also comprises a housing 30 having a lower barrel portion 34 having a longitudinally arranged tubular bore 31 centered on centerline 100 for receiving the barrel portion 22 of the sleeve 20, and an upper portion 35, also shown as having a cylindrical shaft, having a plurality of control pin bores 33 extending radially from and spaced apart along the centerline 100, and that register with the operating pins bores 23 when assembled. Thus, the control pins bores 33 align with the corresponding operating pin bores 23 of the sleeve 20, with their respective centerlines passing through the centerline axis 100 of the tubular bore 31. The upper portion 35 also has a longitudinally-arranged retaining chamber 39 for receiving and accommodating tangential movement of the securing lug 27, as the sleeve 20 rotates relative to the housing 30. A portion of the housing 30 is removed proximate a rearward portion of the interface of the lower barrel portion 34 and the upper barrel portion 35 to form a securing slot 37 having a rearward-facing securing shoulder 36.

The sleeve 20 and housing 30 cooperate for partial rotational movement of the sleeve within the housing around centerline 100, between a first position and a second position. In the first or retained position, shown in FIG. 21, the securing lug 27 extends tangentially through and beyond the securing slot 37, where the securing shoulder 26 can engage a complementary recess 5 in the inner surface 6 of the core receptacle 4. In the second or removal position, the securing lug 27 of the sleeve 20, as well as the extension 24, are disposed within the retaining chamber 39 of the housing 30, and fully within the cross-sectional Figure-8 profile of the housing 30, as shown in FIG. 22, thereby allowing axial movement and removal of the key-removable lock core 8 from the core receptacle 4, as shown in FIG. 23.

Associated with the pin chambers are a plurality of tumbler pins 41. The tumbler pin 41 is generally the same cross section as the tumbler bore 13, typically circular, and is sized to almost the diameter or cross-sectional dimension of the tumbler bore to allow essentially frictionless axial movement within the tumbler bore. Though not clearly illustrated but as well known in the art, the tumbler bore 13 has a chamfer within the keyway 11 which prevents the tumblers 41 from dropping completely down into the keyway 11.

Also associated with the pin chambers are a plurality of operating pins 51. The operating pin 51 is generally the same cross section as the operating pin bore 23, typically circular, and is sized to almost the diameter or cross-sectional dimension of the operating pin bore to allow essentially frictionless axial movement within the operating pin bore. The lower face or surface of the operating pin 51 interfaces with the upper face or surface of the tumbler pin 41, which two faces can be separated tangentially when the interface is positioned at the operating shear line 45 formed between the outer periphery 12 of the cylindrical key plug 10 and the inner cylindrical surface of the sleeve bore 21.

Additionally associated with the pin chambers are a plurality of control pins 61. The control pin 61 is generally the same cross section as the control pin bore 33, and is typically circular, and is sized to almost the diameter or cross-sectional dimension of the control pin bore to allow essentially frictionless axial movement within the control pin bore. The lower face or surface of the control pin 61 interfaces with the upper face or surface of the operating pin 51, which two faces can be separated tangentially when the interface is positioned at the control shear line 55 formed between the top surface of the sleeve extension 24 of the sleeve 20 and the upper, inner surface of the retaining chamber 39 of the housing 30. The shear line 55 is shown in FIGS. 5 and 16.

A disc plug 69 is friction forced into the top opening of the control pin bore 33 to retain a biasing member shown as biasing spring 68, which biases the tumbler 41, control pin 61 and operating pin 51 within the pin chamber toward the keyway 11.

Figure 13:
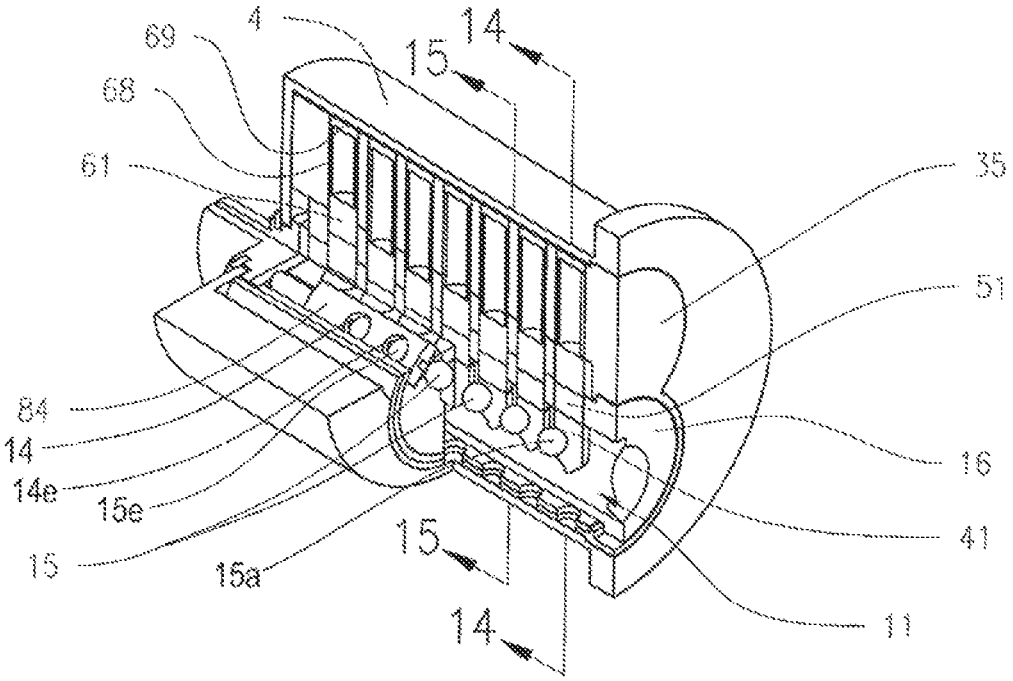
FIG. 13 shows a perspective, assembled view of the key-removable lock core of FIG. 10, disposed within a core receptacle shown in partial, axial sectional view.
Figure 12:
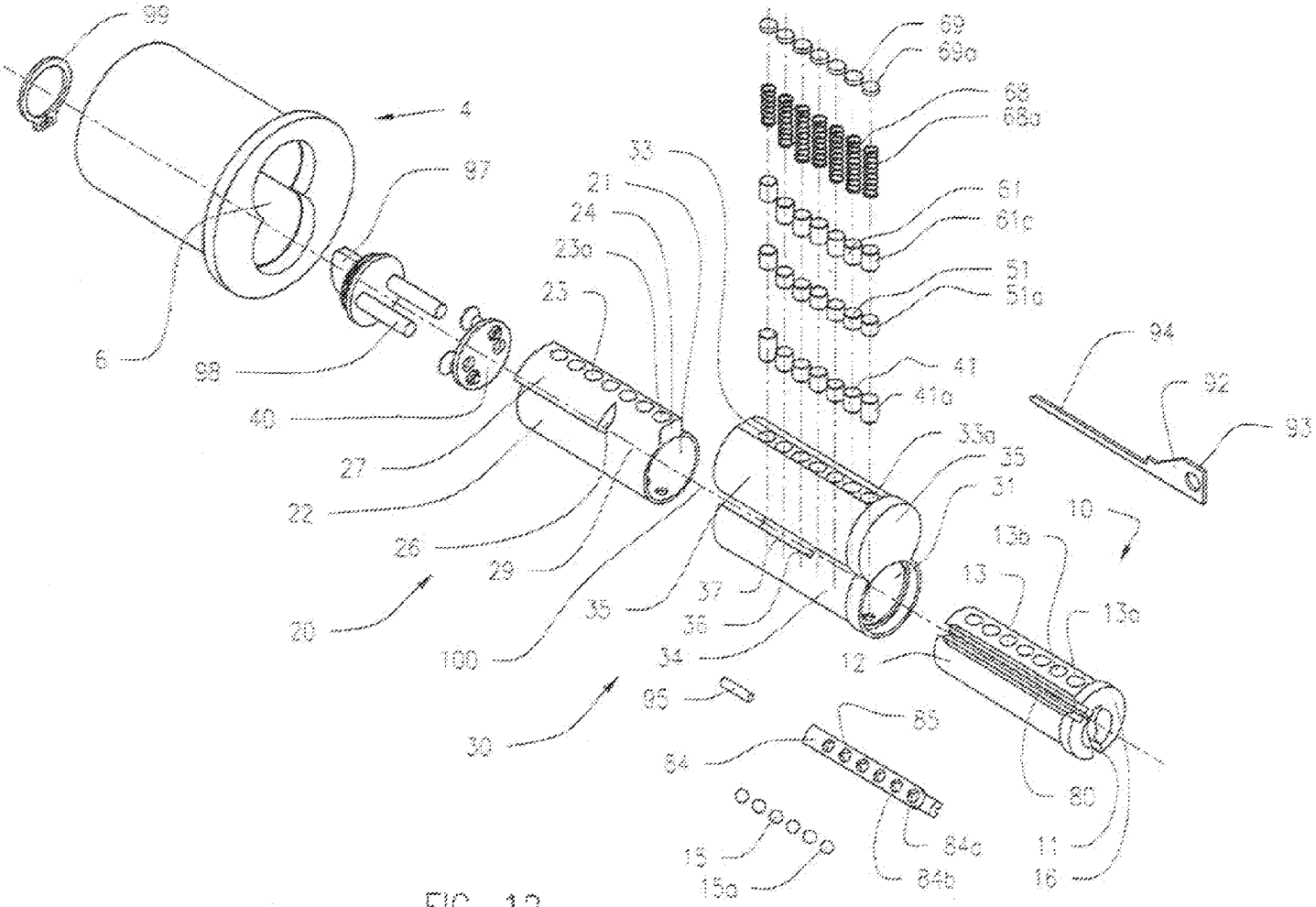
FIG. 12 shows a perspective, exploded view of a key-removable lock core of the present invention.
Figure 14:
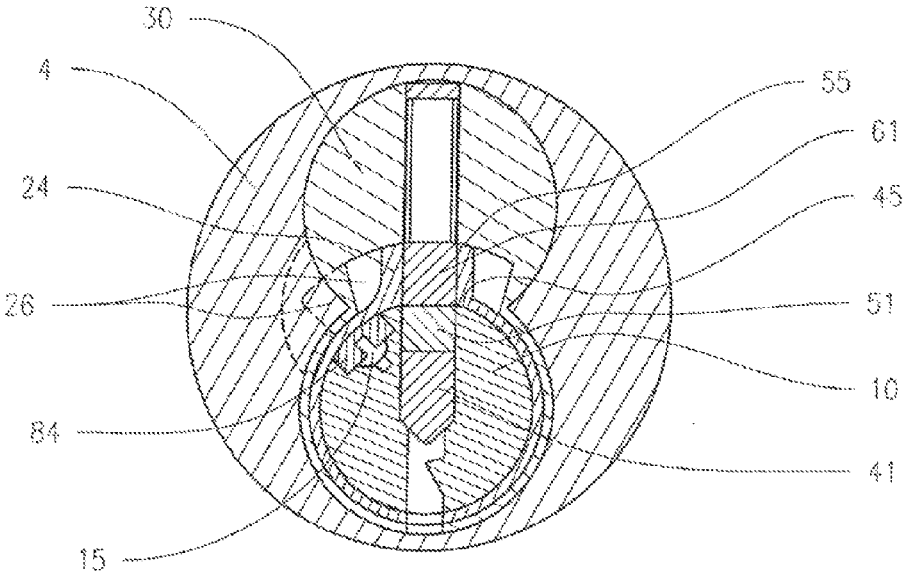
FIG. 14 shows a transverse sectional view of the key-removable lock core through line 14-14 of FIG. 13.
Figure 15:
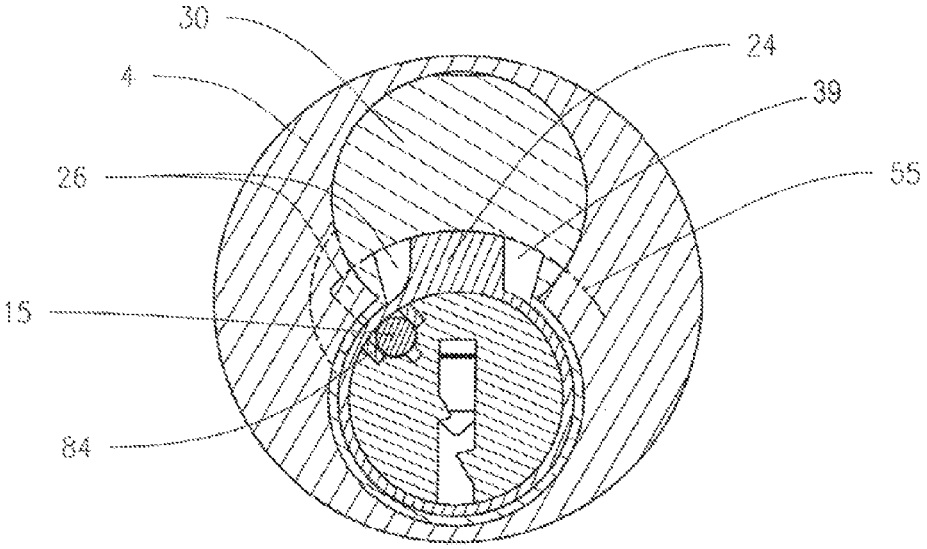
FIG. 15 shows a second transverse sectional view of the key-removable lock core through line 15-15 of FIG. 13.
Figure 16:
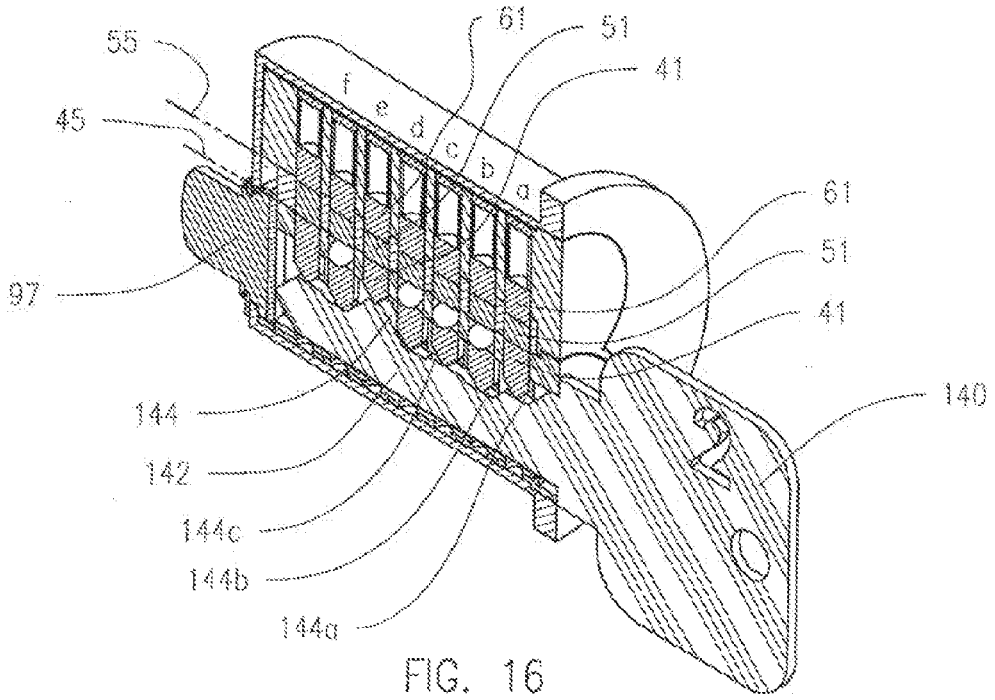
FIG. 16 shows a partial cut-away view of the key-removable lock core configured for operation with an inserted second user key with change balls in pin chambers and carriage bores.
Figure 17:
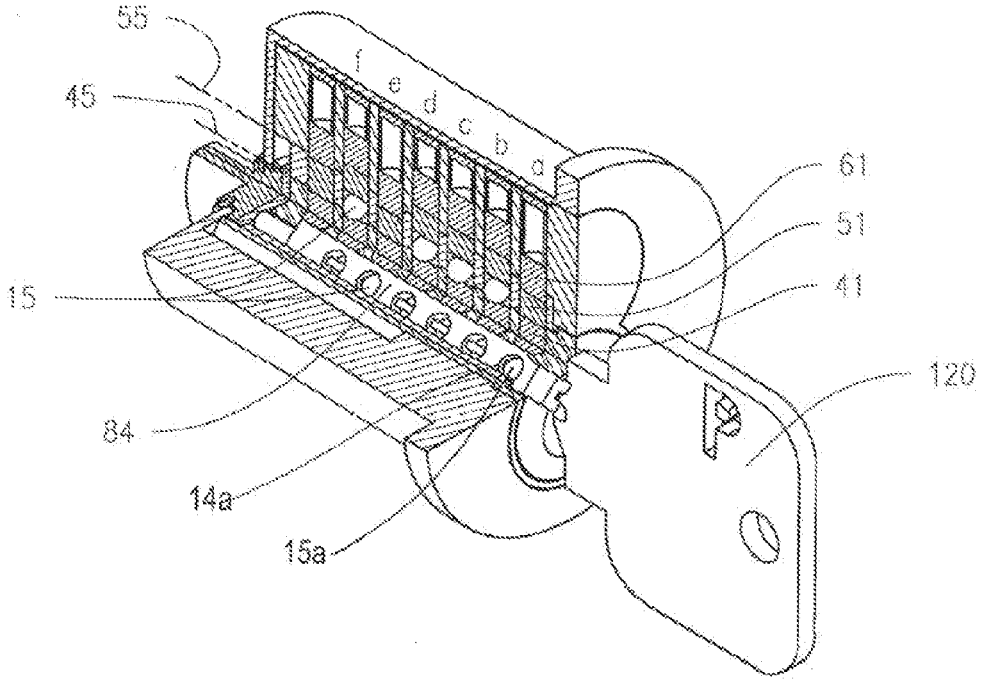
FIG. 17 shows the key-removable lock core of FIG. 16 with a programming key inserted.

Operation of the key-removable lock core is illustrated in FIGS. 13-23. The key-removable lock core shown in FIG. 13 is configured with all the change balls 15 in retainer bores 85, and none in a pin chamber. In another lock configuration shown in FIG. 16, a second operating or user key 140 (labeled "2") is shown inserted into the keyway 11. The operating key 140 has a blade portion 142 having sidewalls with a profile that conform to the sidewall profile of the keyway 11, and a top contour 144 having contour positions 144*a*, 144*b*, and so forth, that register with pin chambers "a", "b", and so forth. When fully inserted into the keyway 11 of the key-removable lock core as shown in FIG. 16, each contour position raises the plurality of pins within the respective pin chamber by a height according to the height of the cut of said contour position 144. The operating key 140 raises the top end of the tumbler pins 41 in pin chambers "a" and "e" to the operating shear line 45, and raises the top of change balls 15 disposed above the tumbler pins 41, pin chambers "b", "c", "d" and "f", to a height wherein the bottom of operating pins 51 are at the operating shear line 45. This arrangement of pins in the pin chambers allows tangential separation of the pins 41 and change balls 15 below the operating shear line, from the control pins 51 above the operating shear line 45, and for the key 140 to rotate the key plug 10 within the sleeve 20. At the same time, the top ends of the plurality of operating pins 51 are not all raised to the control shear line 55; rather, a plurality of the control pins 61, including control pins 61*a* and 61*e*, span across the control shear line 55, and lie partly within the operating pin bore 23 and the control pin bore 33, thereby preventing relative rotation of the sleeve 20 within the housing 30. Consequently, use of the operating key 140 allows the plug to be freely rotated within the sleeve 20 to lock and unlock the associated latch or bolt with which the key-removable lock core is associated, but does not effect rotation of the sleeve within the housing.

Figure 18:
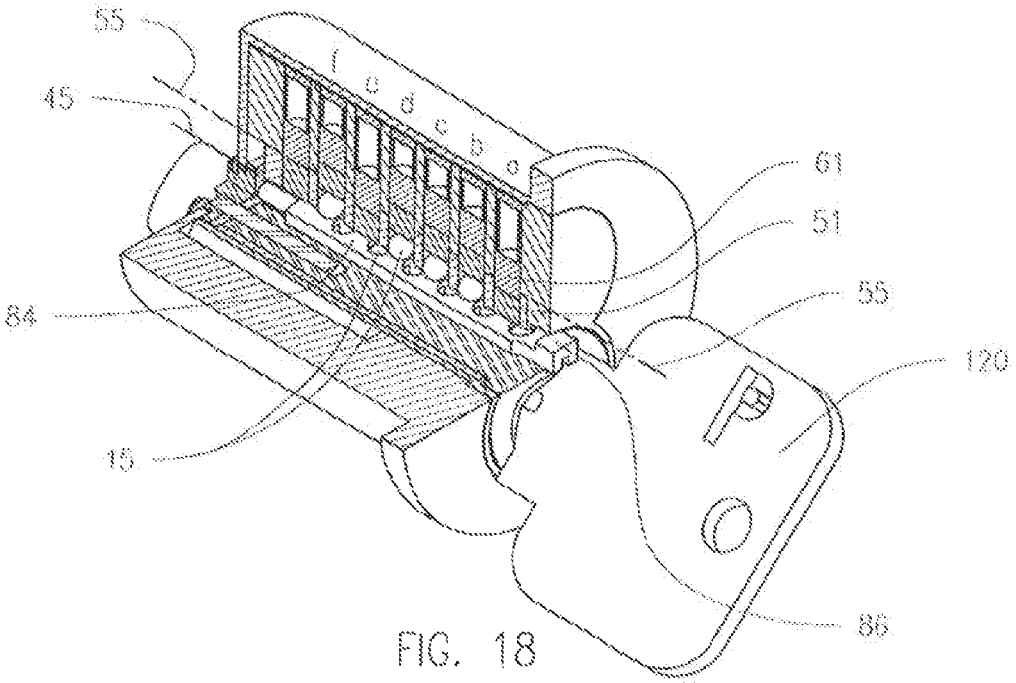
FIG. 18 shows removable lock core of FIG. 17 rotated to the control position with change ball 15 disposed above the carriage.
Figure 19:
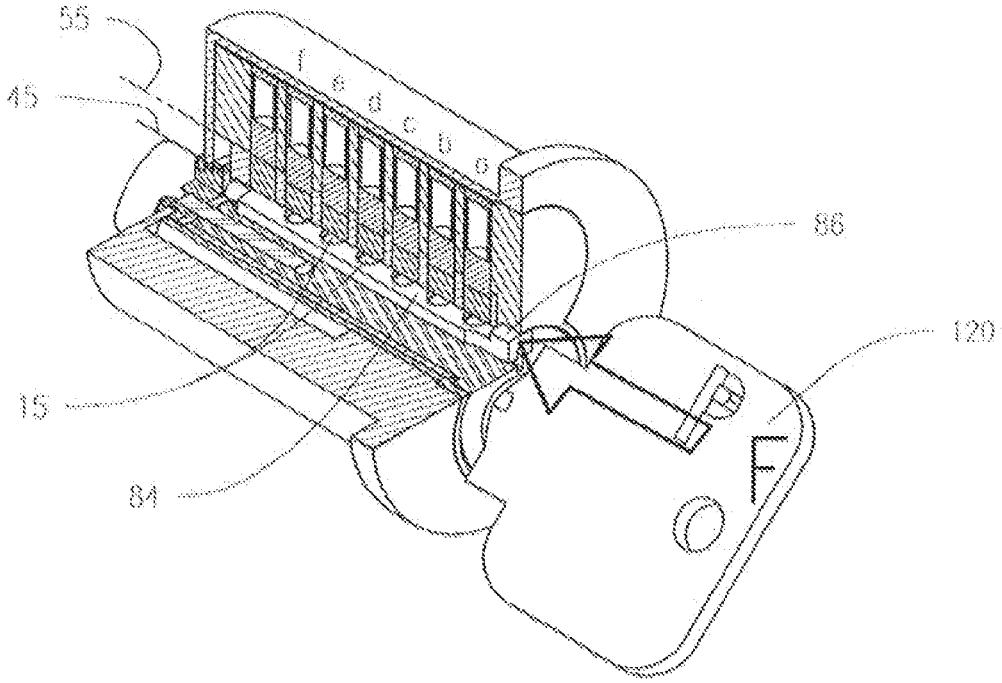
FIG. 19 shows removable lock core of FIG. 18 with the carriage pressed rearwardly to drop change balls into the retainer bores.

In FIGS. 17-23, the key plug 10 is operated with a programming key 120 (labeled "P") for resetting the lock to a non-user key configuration, and for removal of the core using a control tooling. With the lock in the same configuration shown in FIG. 16, the programming key 120 is inserted into the keyway 11. The programming key 120 is configured with raised a contour position associated with every pin chamber, to raise the top of each tumbler bore 41 to the operating shear line 45. This configuration places the remaining change balls 15 in pin chambers "b", "c", "d" and "f" into their respective operating pin bores 23 above the operating shear line 45. In FIG. 18, the key plug 10 is shown rotated by the programming key 120 to a first rotated position, R1, wherein the retainer bores 85 of the carriage 84 are tangentially registered, though axially out of alignment, with the operating pin bores and the control pin bores comprising the pin chambers. A mark 105 can be made on the front face of the housing 30 to signal the proper positioning of the key plug 10 within the sleeve 20. Other visual, audible or tactile means well known in the art for signaling a position of the plug within the sleeve and/or housing can be employed. In this position, change balls 15*a* and 15*e* are disposed within their respective retainer bores 85*a* and 85*e*, while change balls 15*b*, 15*c*, 15*d* and 15*f* are disposed above the carriage 84 in its unaligned second position. Manipulation of the button 86, by pushing the button into the face, biases the carriage to its second, aligned position (with the operating pin bores 23), causing the change balls 15 to spontaneously drop into their respective retainer bores 85 below pin chambers "b", "c", "d" and "f", as shown in FIG. 19. The lock in this configuration is understood to be in "programming" mode, wherein the lock could not be operated with any user key having a contour that is lowered, as described in detail in U.S. Pat. No. 7,802,455. Furthermore, the control shear line 55 remains spanned by all of control pins 61*a*-61*f*, preventing rotation of the sleeve 20 within the housing 30.

Figure 20:
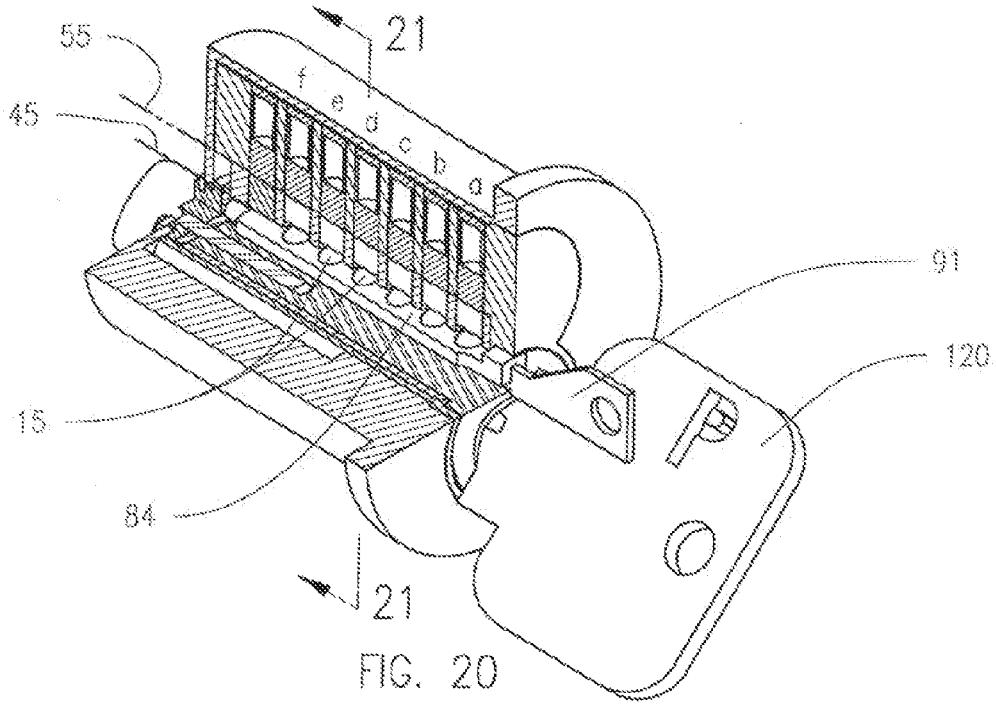
FIG. 20 shows the key-removable lock core of FIG. 18 with the control tooling inserted to raise the change balls partially within the groove, to align control pins along the control shear line.
Figure 21:
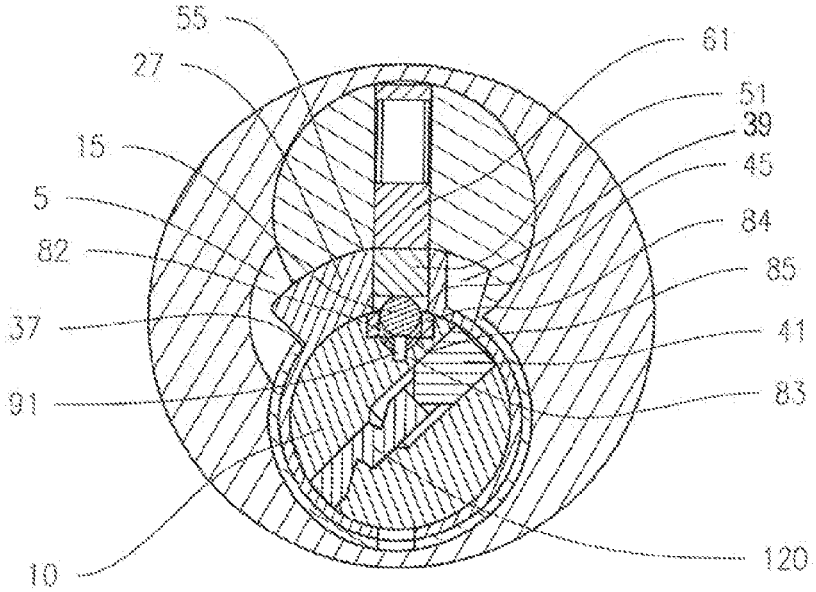
FIG. 21 shows a transverse sectional view of the key-removable lock core through line 21-21 of FIG. 19.
Figure 22:
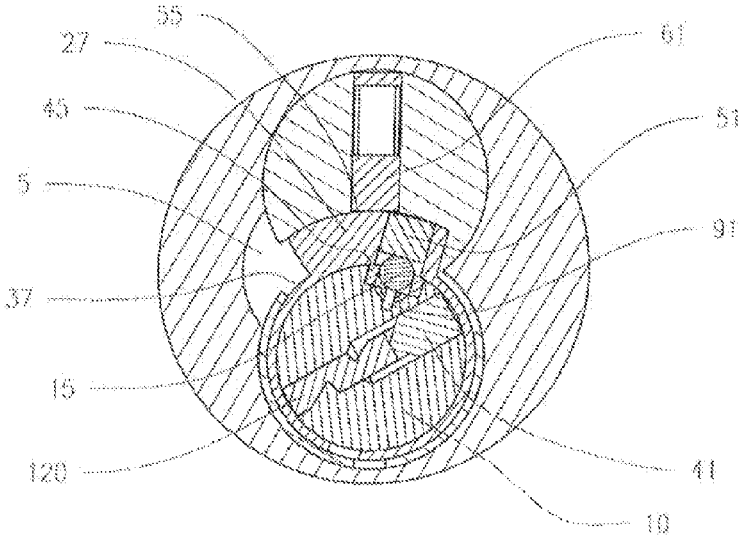
FIG. 22 shows the transverse sectional view of the key-removable lock core of FIG. 21 with the key plug further rotated by the programming key to a position for retracting the securing lug into the profile of the housing.
Figure 23:
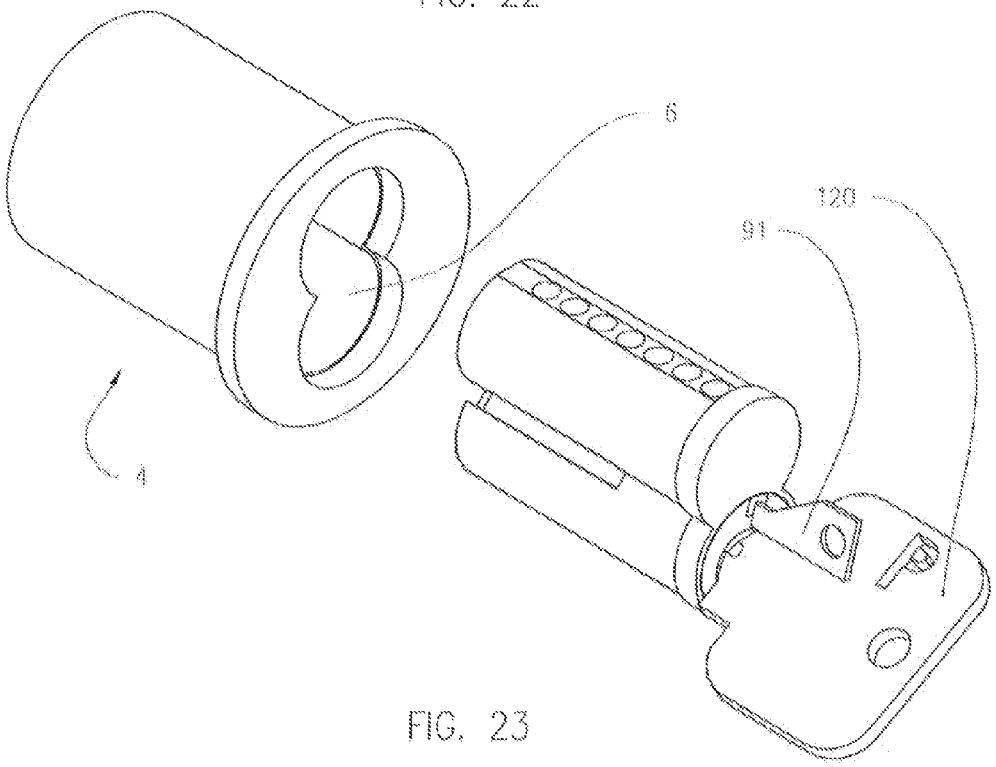
FIG. 23 shows the key-removable lock core of FIG. 22 with the plug core withdrawn from the core receptacle.
Figure 24:
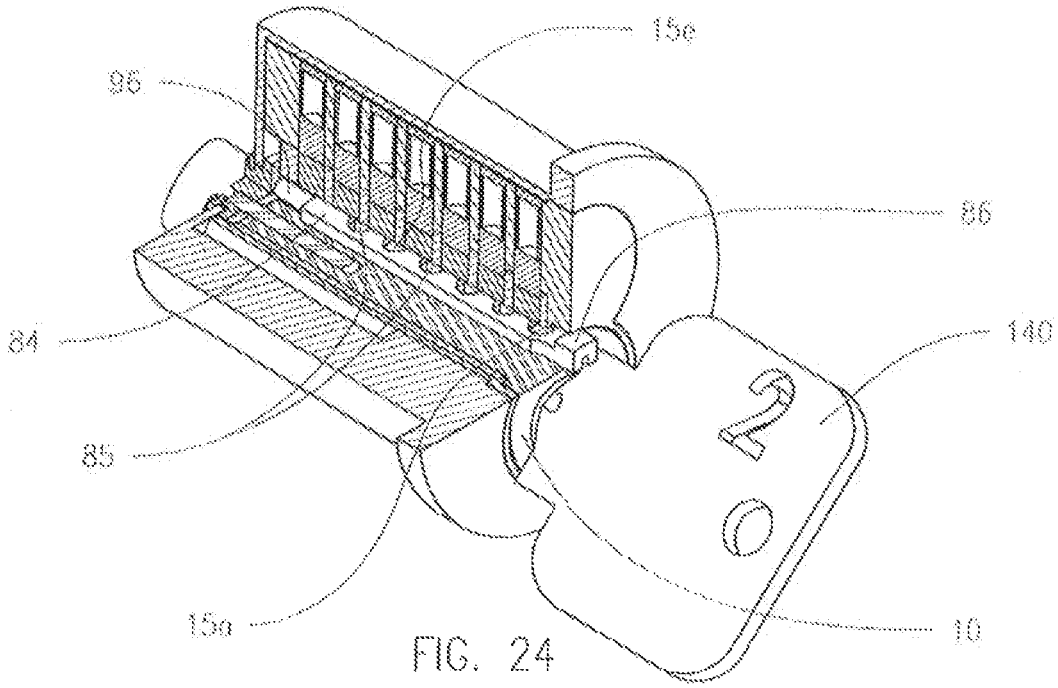
FIG. 24 shows the key-removable lock core configured for operation with an inserted second user key, with change balls in pin chambers and carriage bores.

In FIGS. 20-22, the key-removable lock core is manipulated with a control tooling to enable the sleeve 20 to rotate in the housing 30 and along the control shear line 55. A control tooling member 91, shown having a handle 93, and an elongated shaft 94, which is inserted by hand through the opening 17 (FIG. 3) in the front face of the plug 10, and within tool slot 83 of groove 80. Manipulation of the blade 94 into the tool slot 83 causes each of the change balls 15 to be forced radially outward, off of the curved trough 82 and within the retainer bore 85, and partially outward beyond the outer periphery of the carriage 84. Each of the change balls 15 is raised partially within the respective retainer bore 85, which correspondingly raise each of the operating tumblers 51 a "control height" amount above the shear line 45. In doing so, the top edges of each of the operating pins 51 is raised to the control shear line 55, whereby none of the operating pins 51 and none of the control pins 61 span across the control shear line 55. Rotation of the programming key 120 enables rotation of the sleeve 20 within the housing 30. Relative rotation of the plug 10 within the sleeve 20 is prevented by the portions of each of the change balls 15 that span the operating shear line 45. From this rotation position, the key-removable lock core assembly 8 can be withdrawn from the core receptacle 4 by axial pulling on the programming key 120, effecting axial movement and removal of the key-removable lock core 8 from the core receptacle 4, as shown in FIG. 23.

As previously described, manipulation of the control tooling 91 within the tool slot 83 raises the change ball 15 only partially within the retainer bore 85, and raises the associated tumbler pin 41, operating pin 51 and control pin 61 by the control height amount above the shear line 45. As shown in FIG. 19, a beveled end at the leading end of the blade 94 of the control tooling allows the tooling to leverage under the change members of all types and shapes, including change balls, barrels and disks.

A second key-removable lock core assembly, having a different arrangement of tumblers, can be inserted into the core receptacle 4 in place of the removed key-removable lock core assembly 8.

Various alternative embodiments of the present invention can be made without departing from the essential features of the invention.

In an alternative embodiment, the securing lug can be disposed on the forward portion of the sleeve, or along the entire length of the sleeve, provided that the core receptacle has a forwardly disposed shoulder or member that blocks axial forward movement of the securing lug in its projected position.

In another alternative embodiment of the present invention, the carriage 84 and can be disposed on the opposed side of the keyway 11 of the key plug 10, whereby rotation of the plug to the first and second positions from the key insertion position is in the counter-clockwise direction.

In a further alternative embodiment, master pins and a master keying system can be used with the key-removable lock core, as is well known in the lock field, by placing master shims or pins between each of the tumbler pins 41 and operating pins 51.

Core Removable with Key Changing

Another embodiment of the invention provides a means and method for reprogramming the key-removable lock core described herein, with one of a plurality of user keys without disassembling the lock or exchanging or re-pinning the tumbler pins, with elimination or reduction of incidental or accidental re-keying of the lock. This embodiment is illustrated in FIGS. 12, 13, 16, 17, and 24-29.

The key-removable lock core shown in FIG. 13 is configured with all change balls 15 in retainer cavities 14, and none in a pin chamber. This lock configuration is referred to as the "programming" configuration, wherein the lock could not be operating with any user key having a contour position that is lowered; that is, a contour position on the user key that is not capable of raising its corresponding tumbler pin 41 and operating pin 51 to a height where the tumbler and operating pins can be separated at the operating shear line 45. In the lock configuration shown in FIG. 16, change balls 15*b*, 15*c*, 15*d* and 15*f* reside in their respective pin chambers, and change balls 15*a* and 15*e* reside in the retainer cavities 14*a* and 14*e*. Operating user key 140 (labeled "2") raises the tumbler pins 41 with change balls 15 in pin chambers "b", "c", "d" and "f" to a height where the bottom of operating pins 51 are at the operating shear line 45, allowing user key 140 to operate the latch 40. FIG. 16 also shows that in pin chambers b, c, d and f, user key 140 raises the top of the tumbler pin 41 to the operating shear line 45. Consequently, any change ball within any of the pin chambers b, c, d and f prior to insertion of user key 140, would be raised above the operating shear line 45, and could be deposited into the respective retainer cavity 14 upon turning the key plug 10 to the programming position.

Figure 25:
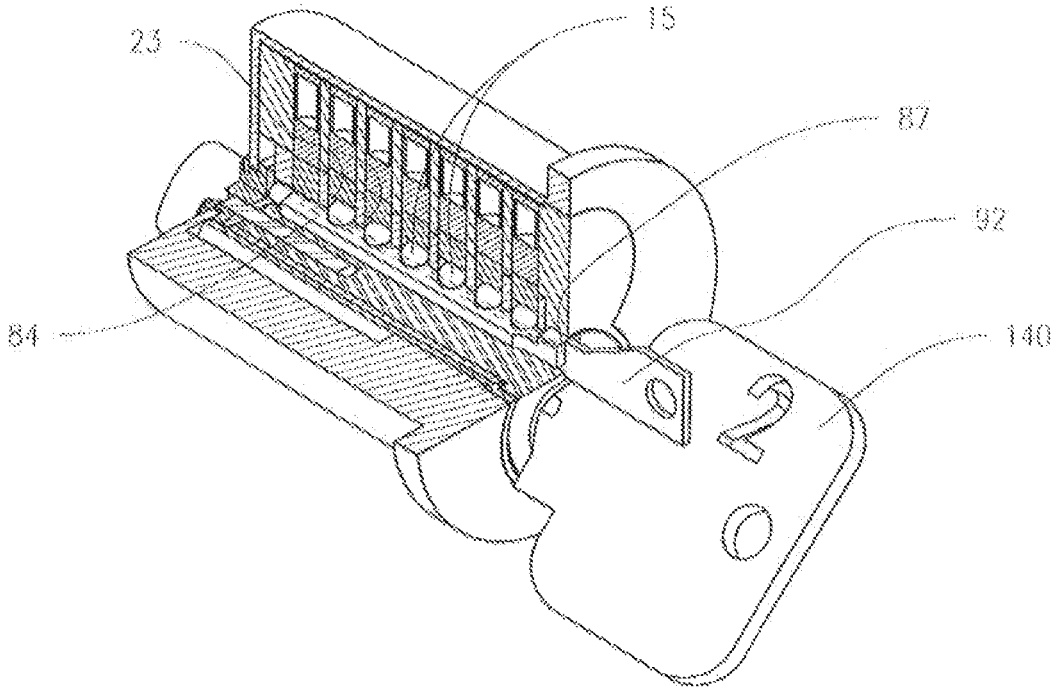
FIG. 25 shows the key-removable lock core of FIG. 24 in the programming position and with a change tooling inserted into the carriage.
Figure 26:
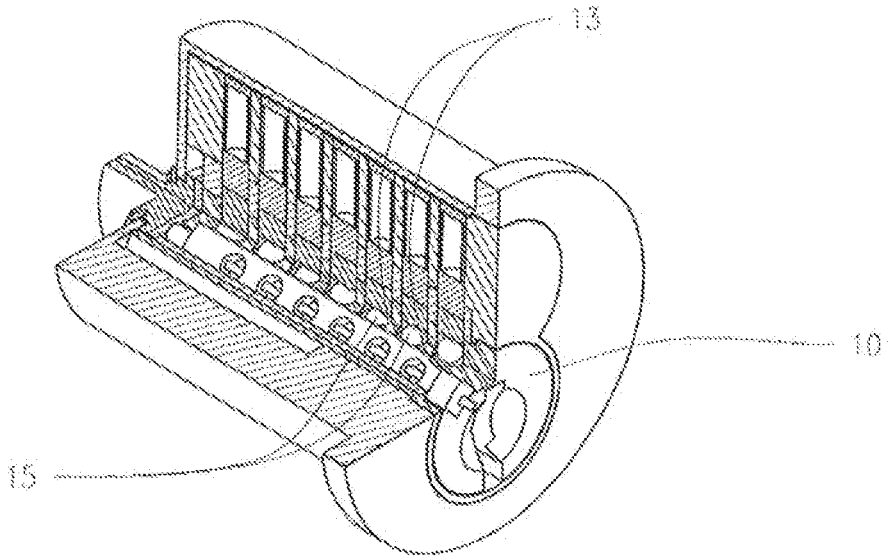
FIG. 26 shows the key-removable lock core in a null configuration with all change balls in the pin chambers.

Therefore, to program the lock to operate with any user key is a set of user keys, the all of the change balls should be moved out of the retainer cavities and into the respective pin chambers, so that the next desired user key can be used to set the lock configuration for that key. This configuration of the lock is called the "null" configuration. To illustrate, user key 140 disposed in the lock shown in FIG. 16, is used to rotate the key plug 10 to the programming position (FIG. 24) wherein change balls 15*a* and 15*e* reside within their respective retainer cavities formed by retainer bores 85 of the carriage 84, which is biased forward by spring 95 so that carriage button 86 extends forward from the plug face. After urging of the carriage 84 rearwardly under force F to its aligned position, and insertion of change tooling 92 into the change tooling slot 87, all change balls 15 are displaced out of their respective retainer cavities and into the operating pin bores 23 (FIG. 25). The user key 140 is then used to rotate the key plug 10 back to the key insertion position, and then removed from the lock and put into the null configuration (FIG. 26).

In an alternative means for setting a lock that is configured for operation with any user key, to the null configuration, the programming key 120 (labeled "P") can be used to set the lock into "programming" mode, as shown in FIGS. 18 and 19, followed by urging of the carriage 84 rearwardly to its aligned position and insertion of change tooling 92 into the carriage tooling slot 87 and tool slot 83, all change balls 15 are displaced out of their respective retainer cavities 14 and into the operating pin bores 23 (as was illustrated above with the second user key 140 in FIG. 25). The user key 140 is then used to rotate the key plug 10 back to the key insertion position, and then is removed from the lock and put into the null configuration (as was illustrated above with the second user key 140 in FIG. 26).

Figure 27:
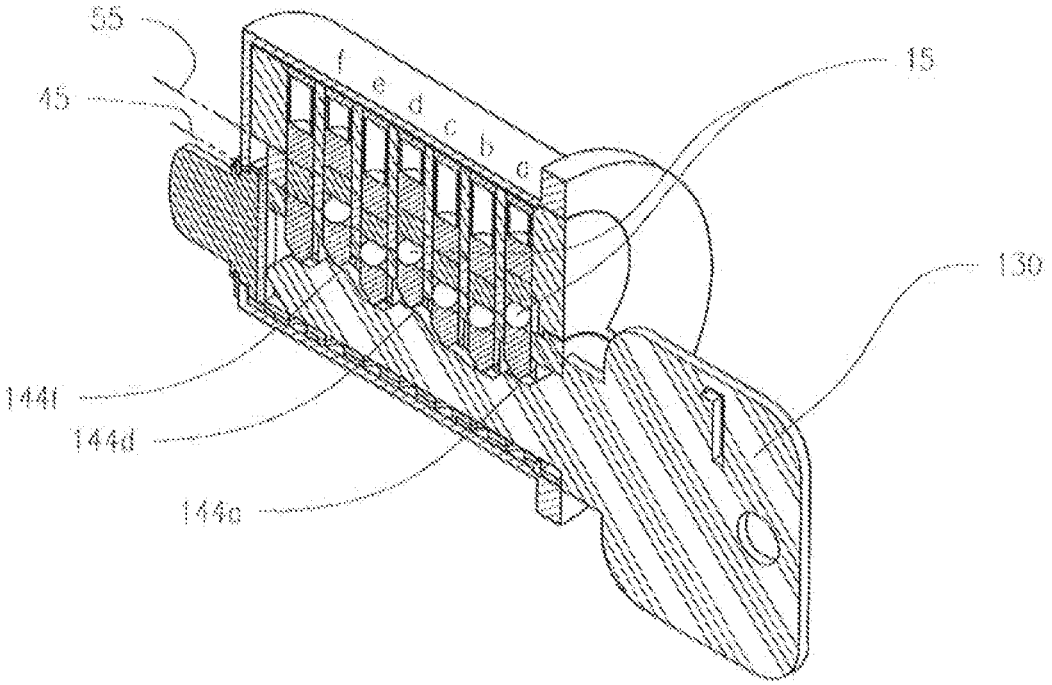
FIG. 27 shows the key-removable lock core in the null configured with a first user key inserted, raising certain of the change balls above the operating shear line.
Figure 28:
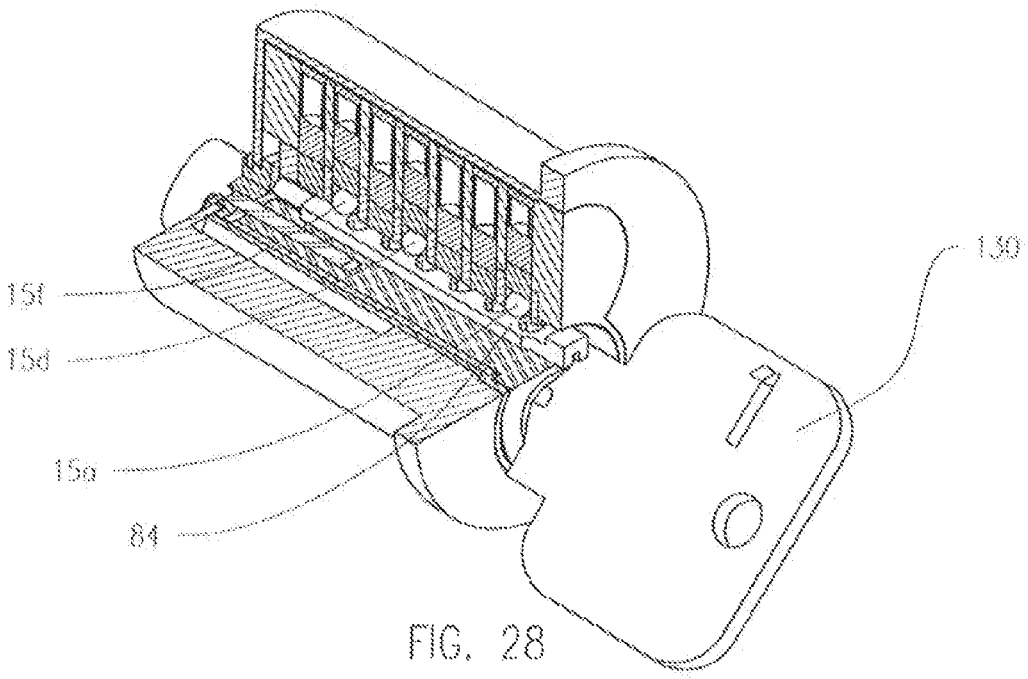
FIG. 28 shows the key-removable lock core of FIG. 27 rotated to the programming position with the certain of the change balls above the carriage.
Figure 29:
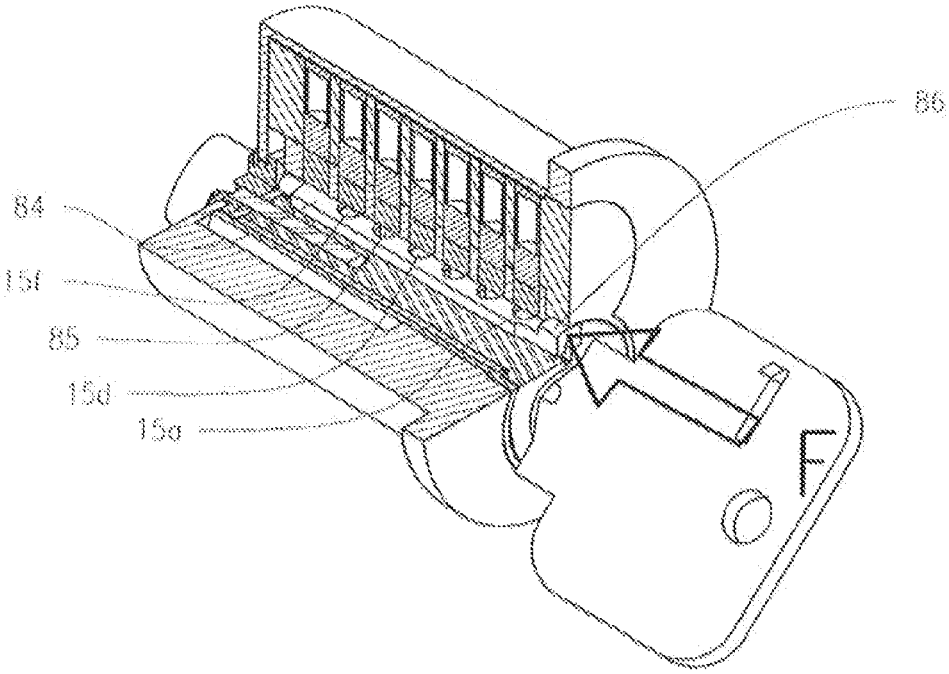
FIG. 29 shows the key-removable lock core of FIG. 28 after depressing the button of the carriage to deposit the change balls into the retainer bores.

A first user key 130 (labeled 1) is then inserted into the keyway of the null-configured lock to raise change balls 15 in pin chambers "a", "d" and "f" above the operating shear line 45, due to the corresponding raised contour positions 144*a*. 144*d*, and 144*f* of the user key 130 (FIG. 27). Rotating the key plug to the programming position disposes the three change balls 15*a*, 15*d*, and 15*f* above the carriage 84, which is biased forward in its unaligned position (FIG. 28). After urging of the carriage 84 rearwardly to its aligned position by depressing button 86 with force F, the three change balls 15*a*, 15*d*, and 15*f* drop down into the respective retainer bores 84 within the carriage 84 (FIG. 29), thus configuring the lock for operation by the first user key 130. The user key 130 is then used to rotate the key plug 10 back to the key insertion position, and then is removed from the lock, with the three change balls remaining their respective retainer cavities.

In similar fashions, the lock can be configured for operation with other user keys having different arrangements and numbers of raised contour positions for moving change balls from the pin chamber to the retainer cavities.

Key-Operated Changeable Lock

The present invention therefore relates to a key-operated, programmable lock that can operate the lock with any one of a plurality of user keys, and is programmable with a programming key to reconfigure the lock to operate with another one of the plurality of user keys, without disassembling the lock.

Figure 30:
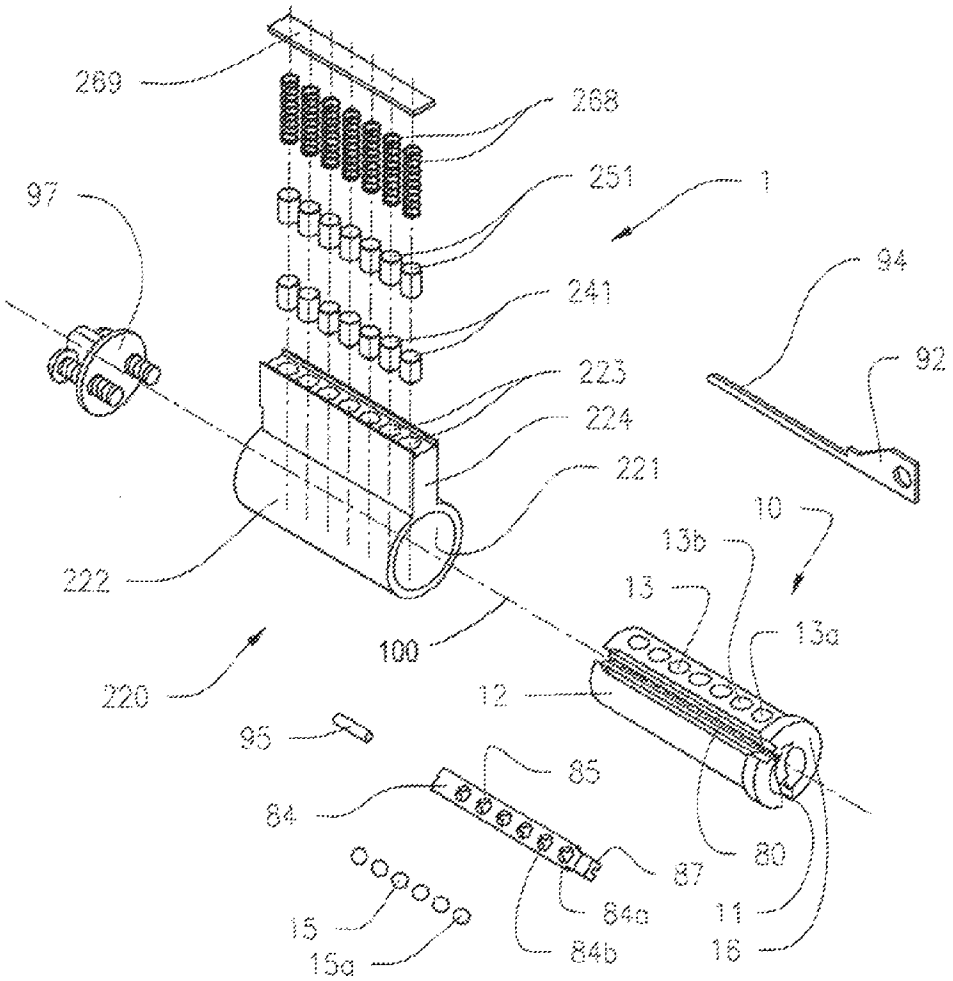
FIG. 30 shows a perspective, exploded view of a key-operated changeable lock of the present invention.

The programmable lock is substantially described in U.S. Pat. No. 7,802,455, the disclosure of which is incorporated by reference in its entirety. The embodiment includes an improved means for retaining the change members within the plug from where they can be moved to and from the pin chambers. Briefly, FIG. 30 shows a programmable lock 1 including a plug 10 and a housing 220 having a cylindrical barrel portion 222 and a stack portion 224. The barrel portion 222 has a cylindrical bore that runs through the length of the barrel portion 222 to form an inner surface 221. A plurality of driver bores 223 are formed along the length of the stack portion 224, and intersect the inner surface 221. The embodiments show seven pin chambers, though other numbers of pin chambers can be used, such as 5, 6, 8 and 9 pin chambers. Each of the driver bores 223 are aligned transverse to the centerline 100 that passes through the longitudinal center of the barrel portion 21. A tumbler pin 21 and driver pin 251 are disposed within each pin chamber, biased toward the plug 10 by a biasing spring 268. A closure plate 269 holds the spring and pins within the pin chambers.

The plug 10 is substantially as described herein previously. A latch plate 97 is secured to the rear end of the plug 10, and extends from the rear end of the housing 20. When the tumbler bores 13 of the plug 10 are axially aligned with the driver bores 223 of the stack portion 224, the plug 10 is in a first rotated position with respect to the housing 220.

An operating shear line is established at the periphery of the plug 10. A key inserted into the plug will operate (turn) the plug within the housing if the pin hardware within a pin chamber (tumblers, drivers, and any change ball within the pin chamber) can separate at the shear line. As described hereinabove, a user key having one or more lower contour positions can operate the lock if there is a change ball within the pin chamber (tumbler bore with the key removed) above the tumbler pin, to raise the driver pin to the operating shear line.

The carriage 84 moveable within the groove 80, and the change tooling 92 insertable within the tool slot 83 of the plug and the change tooling slot 87 of the carriage can raise any one or more change balls, disposed within the retainer bores, outward radially to a position out of their respective retainer bores and into the driver bores 223. As described herein and shown in FIG. 11, a change tooling 92 has a blade height that extends into the curved trough 82, and typically into the change tooling slot 87 within the carriage 84, and raises the change ball substantially out through the outer opening the retainer bores 85. With the retainer bores 84 aligned with the driver bores 223 of the lock housing 220, at least the center of the partially-raised change ball 15 is displaced outside the plug periphery 12, and optionally substantially the entire ball 15 is displaced outside the periphery, and the change ball 15 is moved out of the retainer bore 85 and into the driver bore 223 when the plug is rotated away.

The embodiments of a key-removable lock core and a key-operated, programmable lock can be used in a variety of locking devices. These locking devices include both commercial and residential locks, and include by example, knob locks, deadbolt locks, and even padlocks.

While the invention has been disclosed by reference to the details of preferred embodiments of the invention, it is to be understood that the disclosure is intended in an illustrative rather than in a limiting sense, as it is contemplated that modifications will readily occur to those skilled in the art, within the spirit of the invention and the scope of the appended claims.

What is claimed is:

1. A key-removable lock core comprising:

a) a sleeve comprising a lower cylindrical barrel portion having a longitudinally formed tubular bore, an upper extension having a plurality of spaced-apart radially-arranged operating pin bores, and a securing lug extending from the sleeve;

b) a housing having (i) a lower body portion having a longitudinally-formed tubular bore for receiving the barrel portion of the sleeve, (ii) an upper body portion having a longitudinally-arranged retaining chamber for receiving the upper extension and securing lug of the sleeve, and a plurality of radially-arranged control pin bores extending to the tubular bore to define a control shear line, and (iii) a securing slot to accommodate tangential movement therethrough of the securing lug;

c) a cylindrical key plug rotatable between a key insertion position and a control position, within the tubular bore of the sleeve, and having a cylindrical periphery, a longitudinally-formed keyway, a plurality of radially-arranged tumbler bores that extend from the keyway to the periphery, to define an operating shear line, the key plug further having an axially arranged groove formed into the periphery of the plug and displaced circumferentially from the plurality of tumbler bores, the groove having, in cross-section, a radially-outermost carriage groove, a radially intermediate curved trough extending radially inwardly from the center of the carriage groove, and a control tooling slot formed radially inwardly from the curved trough;

d) a plurality of tumbler pins disposed for axial movement within the plurality of tumbler bores;

e) a plurality of operating pins disposed for axial movement within the plurality of operating pin bores;

f) a plurality of control pins disposed for axial movement within the plurality of control pin bores;

g) a carriage disposed and moveable axially within the carriage groove between a first and second position, having an outer surface proximate with the cylindrical periphery of the key plug, and having a plurality of radially-formed retainer bores that register with the operating pin bores of the sleeve with the carriage in the second axial position and the key plug is disposed in the control position;

h) at least one change ball disposed in at least one of the retainer bores of the carriage and within the curved trough; and j) a tooling configured for manipulation within the control tooling slot to intersect at least a portion of the curved trough, for biasing the at least one change ball at least partially out of the curved trough and at least partially into an associated operating pin bore in the sleeve when the key plug is disposed in the sleeve in the control position.

2. The key-removable lock core according to claim 1 wherein the tooling is a control tooling that is separate from the key plug, wherein the inserted control tooling raises the at least one change ball only partially out through an outer opening of the retainer bore, where the center of the partially-raised change ball remains within the periphery of the key plug.

3. The key-removable lock core according to claim 1 wherein the tooling is a change tooling including a blade that is separate from the key plug, wherein the blade of the inserted change tooling raises the at least one change ball substantially out through an outer opening of the retainer bore, where at least the center of the partially-raised change ball is displaced outside the periphery of the key plug.

4. The key-removable lock core according to claim 3, wherein the carriage further has an axially-arranged change tooling slot along a bottom surface of the carriage, that intersects a lower portion of the plurality of retainer bores, and into which the blade of the change tooling is inserted for intersecting at least a portion of the plurality of retainer bores.

5. The key-removable lock core according to claim 1, wherein the carriage has a front end portion that extends through a front face of the key plug when the carriage is in the first position.

6. The key-removable lock core according to claim 5, wherein the carriage is biased toward the first position by a spring, and is moved from the first position to the second position by manually depressing the front end portion of the carriage.

7. The key-removable lock core according to claim 1, wherein the plurality of radially-formed retainer bores are circularly shaped.

8. A programmable cylinder lock for operating a bolt or a latch, that can be reconfigured to operate with a user key selected from a set of keys, without disassembling the lock or replacing one or more tumblers of the lock, including:

a) a set of keys comprising a plurality of user keys;

b) a housing having a cylindrical bore with an inner surface and a plurality of driver bores intersecting the inner surface;

c) a plurality of drivers, each driver being movable within one of the plurality of driver bores, and having a means for urging each driver toward the inner surface;

d) a plug having a cylindrical periphery and rotatably mounted within the bore to form a shear surface at the interface with the inner surface, the plug being rotatable from a key insertion position to an operating position, and to a programming position, the plug having:

i) a keyway configured to receive a key selected from the set of keys, ii) a plurality of tumbler bores intersecting the plug periphery and the keyway, each tumbler bore being aligned with a corresponding one of the plurality of driver bores when the plug is at the key insertion position to form a pin chamber, and iii) an axially-formed groove in the periphery of the plug that is displaced circumferentially from the plurality of tumbler bores, the groove having, in cross-section, a radially-outermost carriage groove, a radially intermediate curved trough extending radially inwardly from the center of the carriage groove, and a change tooling slot extending radially inwardly from the curved trough;

e) a plurality of tumblers, each tumbler being movable within a corresponding one of the plurality of tumbler bores;

f) a carriage disposed and moveable axially within the carriage groove between a first axial position and a second axial position, the carriage having an outer surface proximate with the cylindrical periphery of the plug, and having a plurality of radially-formed retainer bores that register with the driver bores of the housing with the carriage in the second axial position and the plug is disposed in the programming position;

g) at least one lock configuration change ball, movable within the lock between at least a second position within the corresponding retainer bore, and a first position within the corresponding driver bore; and h) a change tooling comprising a blade configured for manipulation within the change tooling slot of the plug, to intersect the curved trough, for biasing the at least one change ball at least partially out of the curved trough, and substantially out through an outer opening of the retainer bore, where at least the center of the partially-raised change ball is displaced outside the periphery of the plug when the plug is disposed in the programming position.

9. The programmable cylinder lock according to claim 8 wherein the change tooling is separate from the plug.

10. The programmable cylinder lock according to claim 8, wherein the carriage further has an axially-formed change tooling slot along a bottom surface of the carriage, that intersects a lower portion of the plurality of retainer bores, and into which the blade of the change tooling is inserted for intersecting at least a portion of the plurality of retainer bores.

11. The programmable cylinder lock according to claim 8, wherein the carriage has a front end portion that extends through a front face of the plug when the carriage is in the first axial position.

12. The programmable cylinder lock according to claim 11, wherein the carriage is biased toward the first axial position by a spring, and is moved from the first axial position to the second axial position by manually depressing the front end portion of the carriage.

13. The programmable cylinder lock according to claim 8, wherein the plurality of radially-formed retainer bores are circularly shaped.

14. A programmable cylinder lock for operating a bolt or a latch, that can be reconfigured to operate with a user key selected from a set of keys, without disassembling the lock or replacing one or more tumblers of the lock, including:

a) a set of keys comprising a plurality of user keys;

b) a housing having a cylindrical bore with an inner surface and a plurality of driver bores intersecting the inner surface;

c) a plurality of drivers, each driver being movable within one of the plurality of driver bores, and having a means for urging each driver toward the inner surface;

d) a plug having a cylindrical periphery and rotatably mounted within the bore to form a shear surface at the interface with the inner surface, the plug being rotatable from a key insertion position to an operating position, and to a programming position, the plug having:

i) a keyway configured to receive a key selected from the set of keys, ii) a plurality of tumbler bores intersecting the plug periphery and the keyway, each tumbler bore being aligned with a corresponding one of the plurality of driver bores when the plug is at the key insertion position to form a pin chamber, and iii) an axially-formed groove in the periphery of the plug that is displaced circumferentially from the plurality of tumbler bores, the groove having, in cross-section, a radially-outermost carriage groove, a radially intermediate curved trough extending radially inwardly from the center of the carriage groove;

e) a plurality of tumblers, each tumbler being movable within a corresponding one of the plurality of tumbler bores;

f) a carriage disposed and moveable axially within the carriage groove between a first axial position and a second axial position, the carriage having an outer surface proximate with the cylindrical periphery of the plug, and having a plurality of radially-formed retainer bores that register with the driver bores of the housing with the carriage in the second axial position and the plug is disposed in the programming position, and further having an axially-arranged change tooling slot along a bottom surface of the carriage, that intersects a lower portion of the plurality of retainer bores;

g) at least one lock configuration change ball, movable within the lock between at least a second position within the corresponding retainer bore, and a first position within the corresponding driver bore; and h) a tooling configured for manipulation within the change tooling slot of the carriage to intersect at least a portion of the curved trough, for biasing the at least one change ball at least partially out of the curved trough and at least partially into an associated driver bore in the housing when the plug is disposed in the housing in the programming position.

15. The programmable cylinder lock according to claim 14 wherein the tooling is a change tooling that is separate from the plug and configured for insertion into the change tooling slot of the carriage, wherein the inserted change tooling raises the at least one change ball substantially out through an outer opening of the retainer bore, where at least the center of the raised change ball is displaced outside the periphery of the plug.

16. The programmable cylinder lock according to claim 14, wherein the plug further has a change tooling slot formed radially inwardly from the curved trough.

17. The programmable cylinder lock according to claim 14, wherein the carriage has a front end portion that extends through a front face of the plug when the carriage is in the first axial position.

18. The programmable cylinder lock according to claim 17, wherein the carriage is biased toward the first axial position by a spring, and is moved from the first axial position to the second axial position by manually depressing the front end portion of the carriage.

19. The programmable cylinder lock according to claim 14, wherein the plurality of radially-formed retainer bores are circularly shaped.

* * * * *